US006244229B1

(12) United States Patent
Nakano et al.

(10) Patent No.: US 6,244,229 B1
(45) Date of Patent: Jun. 12, 2001

(54) VALVE LIFTER FOR THREE-DIMENSIONAL CAM AND VARIABLE VALVE OPERATING APPARATUS USING THE SAME

(75) Inventors: Shuuji Nakano; Yoshihito Moriya, both of Nagoya; Hideo Nagaosa; Shinichiro Kikuoka, both of Aichi-ken, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/352,953

(22) Filed: Jul. 14, 1999

(30) Foreign Application Priority Data

Sep. 4, 1998 (JP) ..... 10-251284

(51) Int. Cl.[7] ..... F01L 1/34

(52) U.S. Cl. ..... 123/90.15; 123/90.28; 123/90.5

(58) Field of Search ..... 123/90.15, 90.17, 123/90.18, 90.27, 90.48, 90.5, 90.28, 193.5

(56) References Cited

U.S. PATENT DOCUMENTS

| | | | | |
|---|---|---|---|---|
| 4,231,267 | * | 11/1980 | Van Slooten | 123/90.48 |
| 4,517,936 | | 5/1985 | Burdio di Aragona . | |
| 4,693,214 | | 9/1987 | Titolo . | |
| 4,747,376 | * | 5/1988 | Speil et al. | 123/90.5 |
| 5,094,197 | * | 3/1992 | Rosa | 123/90.27 |
| 5,099,812 | * | 3/1992 | Yamada | 123/90.28 |
| 5,159,906 | * | 11/1992 | Fontichiaro et al. | 123/90.18 |
| 5,454,353 | * | 10/1995 | Elendt et al. | 123/90.5 |
| 5,606,942 | * | 3/1997 | Tsuzuku et al. | 123/90.28 |
| 5,651,335 | * | 7/1997 | Elendt et al. | 123/90.5 |
| 5,673,661 | * | 10/1997 | Jesel | 123/90.5 |
| 5,746,167 | * | 5/1998 | Jesel | 123/90.48 |
| 5,832,884 | * | 11/1998 | Haas et al. | 123/90.48 |
| 5,864,948 | * | 2/1999 | Jesel | 123/193.5 |
| 5,870,984 | * | 2/1999 | Hasegawa et al. | 123/90.18 |
| 5,975,038 | * | 11/1999 | Fischer et al. | 123/90.5 |
| 5,988,128 | * | 11/1999 | Moriya et al. | 123/90.18 |
| 6,032,631 | * | 3/2000 | Haas et al. | 123/90.5 |
| 6,053,133 | * | 4/2000 | Faria et al. | 123/90.5 |
| 6,067,947 | * | 5/2000 | Moriya et al. | 123/90.18 |

FOREIGN PATENT DOCUMENTS

| | | |
|---|---|---|
| 10-121296 | 12/1998 | (JP) . |
| 10-121925 | 12/1998 | (JP) . |

OTHER PUBLICATIONS

"The Variable Valve Timing System—Application on a V8 Engine", A. Titolo, SAE 910009, pp. 8–15.

* cited by examiner

*Primary Examiner*—Teresa Walberg
*Assistant Examiner*—Fadi H. Dahbour
(74) *Attorney, Agent, or Firm*—Oliff & Berridge, PLC

(57) ABSTRACT

A valve lifter for a three-dimensional cam and a variable valve operating apparatus have enhanced flexibility in the design of a detent mechanism of the valve lifter for the three-dimensional cam, as well as enhanced durability. It is possible to form a thick wall portion which is sufficiently thick without increasing the weight by providing an offset between an outer peripheral surface and an inner peripheral surface of the valve lifter. Therefore, a sufficiently large projection can be mounted without deforming the valve lifter. This structure makes it possible to increase an area contacting a detent groove, reduce the surface pressure, and enhance the durability. The thick wall portion exists longer in an axial direction of the valve lifter, so the detent mechanism can be formed on the outer peripheral surface instead of a top surface. Therefore, the flexibility of design of the detent mechanism can be enhanced.

15 Claims, 38 Drawing Sheets

VALVE LIFTER FOR THREE-DIMENSIONAL CAM AND VARIABLE VALVE OPERATING APPARATUS USING THE SAME

INCORPORATION BY REFERENCE

The disclosure of Japanese Patent Application No. HEI 10-251284 filed on Sep. 4, 1998 including the specification, drawings and abstract is incorporated herein by reference in its entirety.

BACKGROUND OF THE INVENTION

1. Field of the Invention

The present invention relates to a valve lifter for a three-dimensional cam used in an internal combustion engine and a variable valve operating apparatus using the valve lifter.

2. Description of the Related Art

There is a known variable valve operating apparatus capable of varying the timing for opening and closing an intake valve or an exhaust valve of an internal combustion engine in accordance with a driving state of the internal combustion engine. As one example of the variable valve operating apparatus, there is a known apparatus for adjusting the opening and closing timing of a valve by varying the lift amount of a valve 1003 using a three-dimensional cam 1002 capable of moving in a direction of a rotation axis as shown in FIG. 38 (Japanese Patent Application Laid-Open No. HEI 10-121926).

In the variable valve operating apparatus using such a three-dimensional cam, the incline angle of a cam surface 1002*a* is varied as the three-dimensional cam rotates. Therefore, a guide groove 1005 extending in parallel with the rotation direction (direction of the arrow S in the drawing) of the three-dimensional cam is formed on a top surface 1004*a* of a valve lifter 1004. A semicolumnar rocking follower 1006 capable of rocking in accordance with variation of the incline angle of the cam surface 1002*a* is fitted in the guide groove 1005 for enhancing the durability by maintaining sufficient contact between the three-dimensional cam 1002 and the valve lifter 1004.

In the aforementioned structure, the cam surface 1002*a* of the three-dimensional cam 1002 applies pressure to the valve lifter 1004 obliquely through the rocking follower 1006. Therefore, a strong moment acts on the valve lifter 1004 about its axis which is caused to rotate in a lifter bore 1009*a* provided in a cylinder head 1009 of the internal combustion engine. The aforementioned rotation of the valve lifter 1004 may change the direction of the rocking follower 1006 undesirably. Therefore, the valve lifter 1004 is provided with a projection 1004*c* at its outer peripheral surface as a detent mechanism for the valve lifter 1004 such that the projection 1004*c* is brought into engagement with a groove formed in an inner peripheral surface of the lifter bore 1009*a* in its axial direction. This mechanism allows the valve lifter 1004 to slide within the lifter bore 1009*a* in its axial direction but not to rotate, thus maintaining the direction of the rocking follower 1006.

However, there has been a recent trend to decrease the thickness of the valve lifter 1004 in order to reduce the weight of the internal combustion engine. This may restrict a position for mounting the projection 1004*c* or its shape as well.

For example, as the detent projection cannot be force fitted to the outer peripheral surface 1004*b* as a thin portion, it is necessary to mount the projection by welding that requires more time than the force fitting. When the projection is mounted on the thin portion by welding, the inside thereof may be deformed to give an adverse effect on roundness of the valve lifter 1004. Further, as a largesized projection cannot be mounted, the surface pressure applied to the groove to be engaged with the projection is increased. It is, thus, probable to threaten deteriorated durability.

A similar problem may be raised when forming a detent groove on the valve lifter 1004. Since a groove with sufficient depth cannot be formed in the thin portion, the area contacting the projection inserted from the cylinder head is reduced to increase the surface pressure. As A result, a detent mechanism having sufficient durability cannot be obtained.

In order to form the detent projection having sufficient contacting area, there has been no alternative but to mount a small-sized projection on a relatively thick portion near the top surface 1004*a* of the valve lifter. The degree of freedom in the detent mechanism design, thus, is extremely lowered.

SUMMARY OF THE INVENTION

The present invention has been accomplished in view of the above problems, and it is an object of the invention to enhance durability of the valve lifter for the three-dimensional cam and a variable valve operating apparatus by increasing the degree of freedom design of a detent mechanism of a valve lifter for a three-dimensional cam.

To achieve the above object, according to a first aspect of the invention, there is provided a valve lifter for a three-dimensional cam accommodated in a lifter bore provided in a cylinder head of an internal combustion engine including a cylindrical outer peripheral surface having a projection engaging a groove in the lifter bore formed at least partially for preventing rotation, and an accommodation chamber for accommodating at least a stem end portion of a valve. The center axis of the cylindrical outer peripheral surface and a center axis of the accommodation chamber are offset, and the projection is formed on the outer peripheral surface at a position corresponding to a thick wall portion at which a distance between the outer peripheral surface and the accommodation chamber generated by the offset becomes substantially maximum.

According to the above aspect, a spatial room constituting the thick wall portion can be generated by the offset between the outer peripheral surface of the valve lifter for the three-dimensional cam and the accommodation chamber in which the structure of the stem end portion are accommodated, and thickness of other portions of the valve lifter can be substantially thin. Therefore, the weight as a whole is not increased, or the valve lifter can further be lightened by further reducing the thickness of the portion except the thick wall portion. The projection can be mounted to the thick wall portion using a simple process, such as a force fitting process. Further, a sufficiently large sized projection can be mounted without generating deformation in the valve lifter for the three-dimensional cam. Therefore, the surface pressure acting on the groove in the lifter bore can be reduced, resulting in no possibility of deteriorated durability.

Further, the position for mounting the detent mechanism of the valve lifter for the three-dimensional cam is no longer limited to the location around the top surface, but to the outer periphery, thus increasing the freedom in designing the detent mechanism to the greatest degree.

In the above aspect, the accommodation chamber may have a cylindrical shape, and the thick wall portion may be formed by the offset between the inner peripheral surface of the accommodation chamber and the outer peripheral surface of the cylindrical chamber.

With the structure, the thick wall portion is formed at the portion where the distance between the outer peripheral surface and the accommodation chamber generated by the offset becomes substantially maximum. This may be realized by offsetting the center axes of the outer peripheral surface and the inner peripheral surface of the cylindrical chamber. The accommodation chamber can be made using a simple process, such as forming a cylindrical hole.

In the above aspect, the projection may have an arcuate, convex surface of a given radius of curvature R opposing a side surface of the groove to be engaged.

In the projection of the detent mechanism, since the surface opposing the side surface of the groove has the arcuate shape, when the valve lifter for the three-dimensional cam is cocked, the angled portions of the upper and lower ends of the projection are prevented from contacting the side surface of the opposing groove as compared with a case having the projection with a straight surface. Therefore, it is possible to maintain the contacting surface pressure at a low level to prevent abnormal abrasion, and to enhance durability of the detent mechanism.

Both ends of the projection opposing the side surface of the groove to be engaged may have shapes that have been gently chamfered.

Even if both ends of the projection facing the side surfaces of the groove have shapes gently chamfered in this manner, when the valve lifter for the three-dimensional cam is cocked, the angled portions of the upper and lower ends of the projection are prevented from contacting the side surface of the opposed groove.

According to another aspect of the invention, there is provided a variable valve operating apparatus including a valve lifter for a three-dimensional cam of the above aspect, a three-dimensional cam rotating in accordance with rotation of an internal combustion engine, and a profile of the three-dimensional cam being varied in a direction of its rotation axis, and a rocking follower swingably supported on the valve lifter for the three-dimensional cam for transmitting, to the valve lifter for the three-dimensional cam, a lift amount of the three-dimensional cam varying in accordance with the rotation of the internal combustion engine by contacting with a cam surface of the three-dimensional cam. An offset of the valve lifter for the three-dimensional cam is provided in the direction of the rotation axis of the three-dimensional cam, and the three-dimensional cam and the rocking follower are disposed at the side of the center axis of the valve stem from the center axis of the outer peripheral surface of the valve lifter for the three-dimensional cam.

In the variable valve operating apparatus having the above structure, the three-dimensional cam and the rocking follower are not disposed on the center axis of the outer peripheral surface of the valve lifter for the three-dimensional cam, but are disposed close to the valve stem. That is, the three-dimensional cam and the rocking follower are located close to the valve stem having the valve lifter for the three-dimensional cam interposed therebetween. Therefore, it is unnecessary to strengthen the rigidity of the top surface of the valve lifter over a wide range, and the rigidity may be maintained in a narrow range between the rocking follower and the valve stem. Therefore, it is unnecessary to enhance the rigidity of the top surface of the valve lifter for the three-dimensional cam over a wide range by increasing the thickness thereof. The weight of the valve lifter for the three-dimensional cam can thus be reduced.

Further, a lift force transmitting path among the three-dimensional cam, rocking follower, the valve lifter for the three-dimensional cam and the valve stem is formed substantially straight. Therefore, the lift force transmitting path cannot easily be deformed even by pressure or impact force due to the rotation of the three-dimensional cam. Therefore, the weight of the valve lifter for the three-dimensional cam is further reduced, and the valve lift amount can be accurately adjusted.

Further, the three-dimensional cam and the rocking follower may be disposed at positions substantially coinciding with the center axis of the valve stem.

With the structure, the aforementioned effects can reduce the weight of the valve lifter for the three-dimensional cam and adjust the valve lift amount accurately.

Further, according to another mode of the invention, there is provided a variable valve operating apparatus including a valve lifter for a three-dimensional cam, a three-dimensional cam rotating in accordance with rotation of an internal combustion engine, and a profile of the three-dimensional cam being varied in a direction of its rotation axis, and a rocking follower swingably supported on the valve lifter for the three-dimensional cam for transmitting, to the valve lifter for the three-dimensional cam, a lift amount of the three-dimensional cam varying in accordance with the rotation of the internal combustion engine by contacting a cam surface of the three-dimensional cam. An offset of the valve lifter for the three-dimensional cam is provided in the direction of the rotation axis of the three-dimensional cam, and the three-dimensional cam and the rocking follower are disposed at a position substantially coinciding with the center axis of the outer peripheral surface of the valve lifter for the three-dimensional cam.

With this structure, since the three-dimensional cam and the rocking follower are disposed to substantially coincide with the center axis of the outer peripheral surface of the cylindrical body, the length of the rocking follower can be set substantially equal to the diameter of the outer peripheral surface. Therefore, the thus set length allows the cam surface of the three-dimensional cam to slide with the rocking follower in a direction perpendicular to the rotation axis of the cam. Thus, the freedom in designing the variation pattern of the lift amount is to the greatest degree, allowing an increase in the lift amount or lift speed by increasing the height of a cam nose of the three-dimensional cam.

Further, the three-dimensional cam and the rocking follower are structured to be away from the valve stem. Accordingly the three-dimensional cam can be positioned away from the journal bearing existing at the side of the valve. Therefore, it is possible to increase the moving amount of the three-dimensional cam in the direction of the rotation axis. Therefore, variation in the lift amount and the variation pattern can be further diversified.

According to another aspect of the invention, there is provided a variable valve operating apparatus including a valve lifter for a three-dimensional cam, a three-dimensional cam rotating in accordance with rotation of an internal combustion engine, and a profile of the three-dimensional cam being varied in a direction of its rotation axis, and a rocking follower swingably supported on the valve lifter for the three-dimensional cam for transmitting, to the valve lifter for the three-dimensional cam, a lift amount of the three-dimensional cam varying in accordance with the rotation of the internal combustion engine by contacting with a cam surface of the three-dimensional cam. An offset of the valve lifter for the three-dimensional cam is provided in the direction of the rotation axis of the three-dimensional cam, and the three-dimensional cam and the rocking follower are disposed at the opposite side of a center axis of the valve stem from the center axis of the outer peripheral surface of the valve lifter for the three-dimensional cam.

According to the aforementioned structure, the three-dimensional cam and the rocking follower are further away from the valve stem. Accordingly the three-dimensional cam is positioned further away from the journal bearing, thus increasing the moving amount in the direction of the rotation axis of the three-dimensional cam. Therefore, variation in the lift amount and the variation pattern can be further diversified.

According to another aspect of the invention, there is provided a variable valve operating apparatus including a valve lifter for a three-dimensional cam, a three-dimensional cam rotating in accordance with rotation of an internal combustion engine, and a profile of the three-dimensional cam being varied in a direction of its rotation axis, and a rocking follower swingably supported on the valve lifter for the three-dimensional cam for transmitting, to the valve lifter for the three-dimensional cam, a lift amount of the three-dimensional cam varying in accordance with the rotation of the internal combustion engine by contacting with a cam surface of the three-dimensional cam. An offset of the valve lifter for the three-dimensional cam is provided in a direction perpendicular to the rotation axis of the three-dimensional cam, and the three-dimensional cam and the rocking follower are disposed at the side of the center axis of the valve stem from the center axis of the outer peripheral surface of the valve lifter for the three-dimensional cam.

With the above structure, the rotation axis of the three-dimensional cam is not disposed at the center axis of the outer peripheral surface of the valve lifter for the three-dimensional cam, but is disposed near the valve stem.

Therefore, the rotation axis of the three-dimensional cam is located at the position shifted from the center of the rocking follower. Therefore, either the length of a side where the rocking follower contacts with the three-dimensional cam at opening of the valve (which will be referred to as the "cam opening side") or the length of a side where the three-dimensional cam contacts with the rocking follower at closing of the valve (which will be referred to as the "cam closing side") becomes longer. If the longer region of the rocking follower is utilized, the valve lifting speed at the initial stage can be easily controlled to be decelerated or accelerated in contrast with the valve lifting speed at the end state, thus increasing the freedom in controlling the valve lift amount.

In the above aspect, the three-dimensional cam may be located at a position where a rotation axis thereof passes the center axis of the valve stem or in the vicinity thereof.

Further, according to another embodiment, there is provided a variable valve operating apparatus including a valve lifter for a three-dimensional cam, a three-dimensional cam rotating in accordance with rotation of an internal combustion engine, and a profile of the three-dimensional cam being varied in a direction of its rotation axis, and a rocking follower rockably supported on the valve lifter for the three-dimensional cam for transmitting, to the valve lifter for the three-dimensional cam, a lift amount of the three-dimensional cam varying in accordance with the rotation of the internal combustion engine by contacting with a cam surface of the three-dimensional cam. An offset of the valve lifter for the three-dimensional cam is provided in a direction perpendicular to the rotation axis of the three-dimensional cam, and the three-dimensional cam is disposed at a position where a rotation axis thereof passes the center axis of the valve stem or in the vicinity thereof.

With the above structure, as the rotation axis of the three-dimensional cam is located at the substantially center of the rocking follower. Therefore, the length of the cam opening side is the same as that of the cam closing side of the rocking follower. Thus, the lift speed can be kept constant both at opening and closing the valve, securing sufficient lift amount.

According to another aspect of the invention, there is provided a variable valve operating apparatus including a valve lifter for a three-dimensional cam, the three-dimensional cam rotating in accordance with rotation of an internal combustion engine, and a profile of the three-dimensional cam being varied in a direction of its rotation axis, and a rocking follower swingably supported on the valve lifter for the three-dimensional cam for transmitting, to the valve lifter for the three-dimensional cam, a lift amount of the three-dimensional cam varying in accordance with the rotation of the internal combustion engine by contacting with a cam surface of the three-dimensional cam. An offset of the valve lifter for the three-dimensional cam is provided in the direction perpendicular to the rotation axis of the three-dimensional cam, and a rotation axis of the three-dimensional cam is disposed at the opposite side of the center axis of the valve stem from the center axis of the outer peripheral surface of the valve lifter.

With the above structure, the three-dimensional cam is positioned away from the valve stem as compared with a case where it is located at the center of the outer peripheral surface of the valve lifter for the three-dimensional cam. Therefore, the rotation axis of the three-dimensional cam is located at a position that has been shifted from the center of the rocking follower.

Further, since the three-dimensional cam is sufficiently away from the valve stem, the distance (pitch between cams) of the shaft of the three-dimensional cam can be increased even in an internal combustion engine in which valves are closely disposed. Conversely, the pitch between cams can be reduced compared with valves. Therefore, the freedom in designing the internal combustion engine can be further improved to the greatest degree.

DETAILED DESCRIPTION OF PREFERRED EMBODIMENTS

Embodiments of the present invention will be explained below with reference to the drawings.

Figure 1:
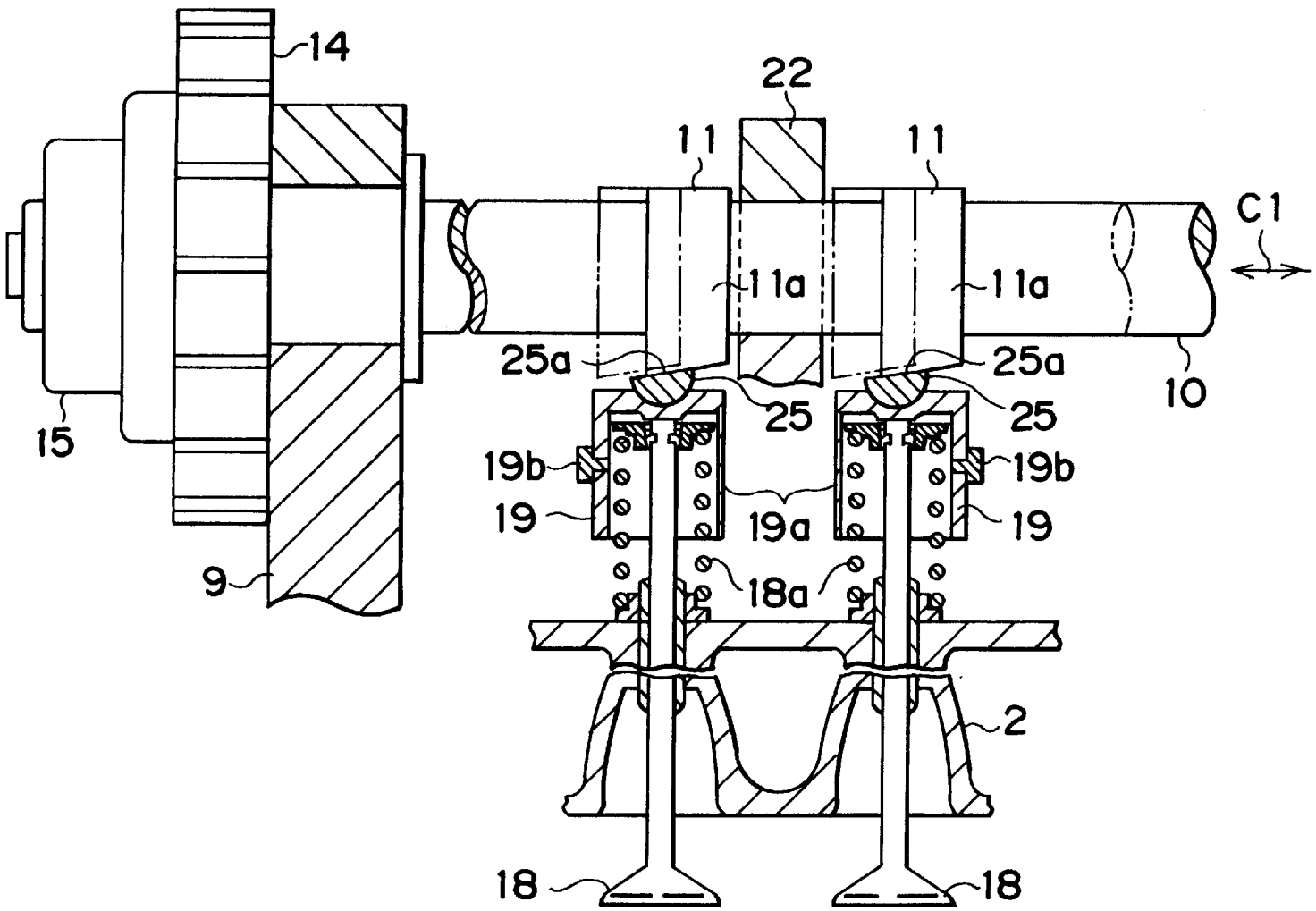
FIG. 1 is a view for explaining a structure of a variable valve operating apparatus of a first embodiment.
Figure 2:
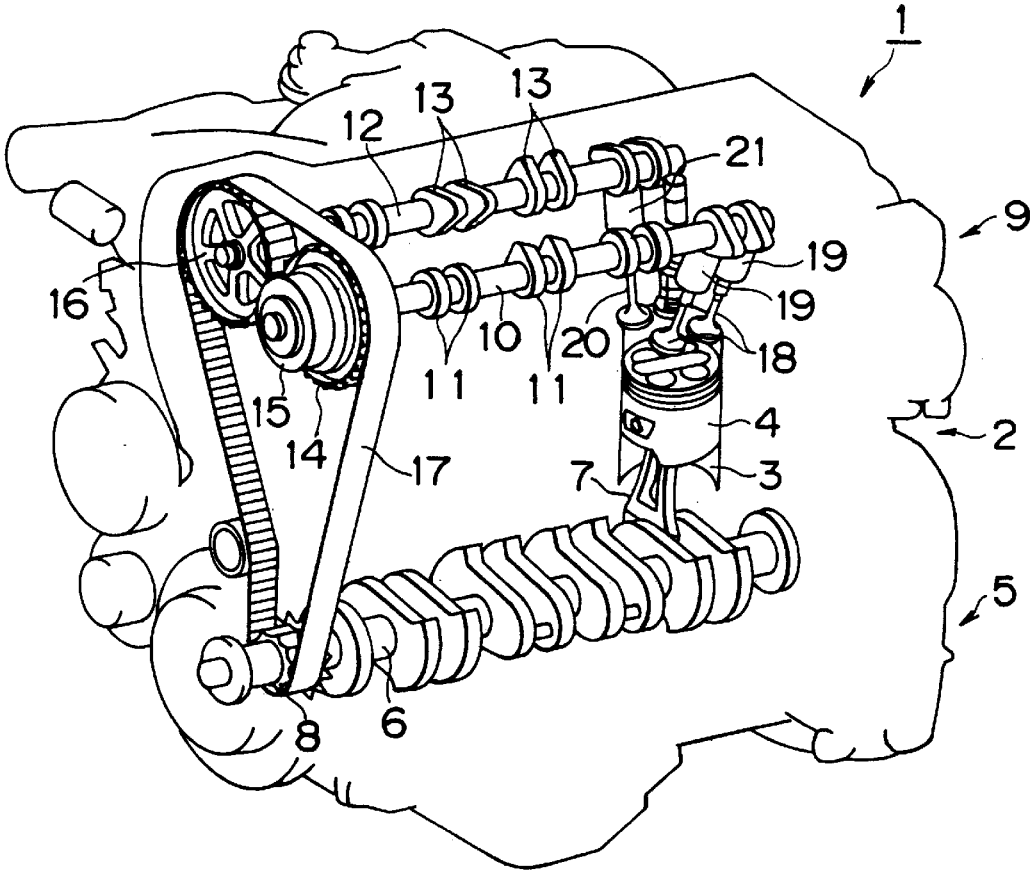
FIG. 2 is schematic view showing a structure of a gasoline engine for a vehicle to which the structure shown in FIG. 1 is applied.

FIG. 1 shows a variable valve operating apparatus using a three-dimensional cam, and FIG. 2 schematically shows a structure of a gasoline engine (which will be referred to as an engine) 1 for a vehicle to which the structure shown in FIG. 1 has been applied. A valve driving type of this engine 1 is a four valve type DOHC (Double Over Head Cam shaft).

A cylinder block 2 of the engine 1 is provided with a plurality of cylinders 3, and a piston 4 is disposed in each of the cylinders 3. Each of the pistons 4 is connected to a crankshaft 6 supported by a crankcase 5 through a connecting rod 7. The crankshaft 6 is provided with a crankshaft timing pulley 8 at one end thereof.

In a cylinder head 9 provided at the upper side of the cylinder block 2, an intake camshaft 10 is rotatively and axially movably (in the direction of the arrow C1 in FIG. 1) supported by a plurality of journal bearings 22. The intake camshaft 10 is integrally provided with intake cams 11, two in each cylinder 3. Similarly, in the cylinder head 9, an exhaust camshaft 12 is rotatively supported by a plurality of journal bearings (not shown) such that the exhaust camshaft 12 can rotate at the exhaust side and is fixed about its rotation axis. Like the intake camshaft 10, the exhaust camshaft 12 is integrally provided with exhaust cams 13, two in each cylinder 3.

The intake camshaft 10 is integrally provided with a camshaft timing pulley 14 and a shaft driving mechanism 15 at one end thereof. The exhaust camshaft 12 is provided with a camshaft timing pulley 16 at one end thereof. The camshaft timing pulleys 14, 16 are connected to the crankshaft timing pulley 8 through a timing belt 17. The intake camshaft 10 and the exhaust camshaft 12 are rotated as the crankshaft 6 rotates.

In each of the cylinders 3, two intake valves 18 are disposed, respectively. Each of the intake valves 18 is driven and connected to the intake cam 11 through a valve lifter 19. Each of the valve lifters 19 is supported in a lifter bore so as to be slidable but not rotatable.

Further, in each of the cylinders 3, two exhaust valves 20 are disposed, respectively. Each of the exhaust valves 20 is driven and connected to the exhaust cam 13 through a valve lifter 21. Each of the valve lifters 21 is slidably supported in a lifter bore (not shown) provided in the cylinder head 9.

The intake cam 11 supported by the intake camshaft 10 is a three-dimensional cam having a cam profile of its cam surface 11 that is continuously varied in stepless manner in a direction of its rotation axis. Meanwhile, the exhaust cam 13 supported by the exhaust camshaft 12 is a normal cam having a cam profile invariant in a direction of its rotation axis.

Figure 3:
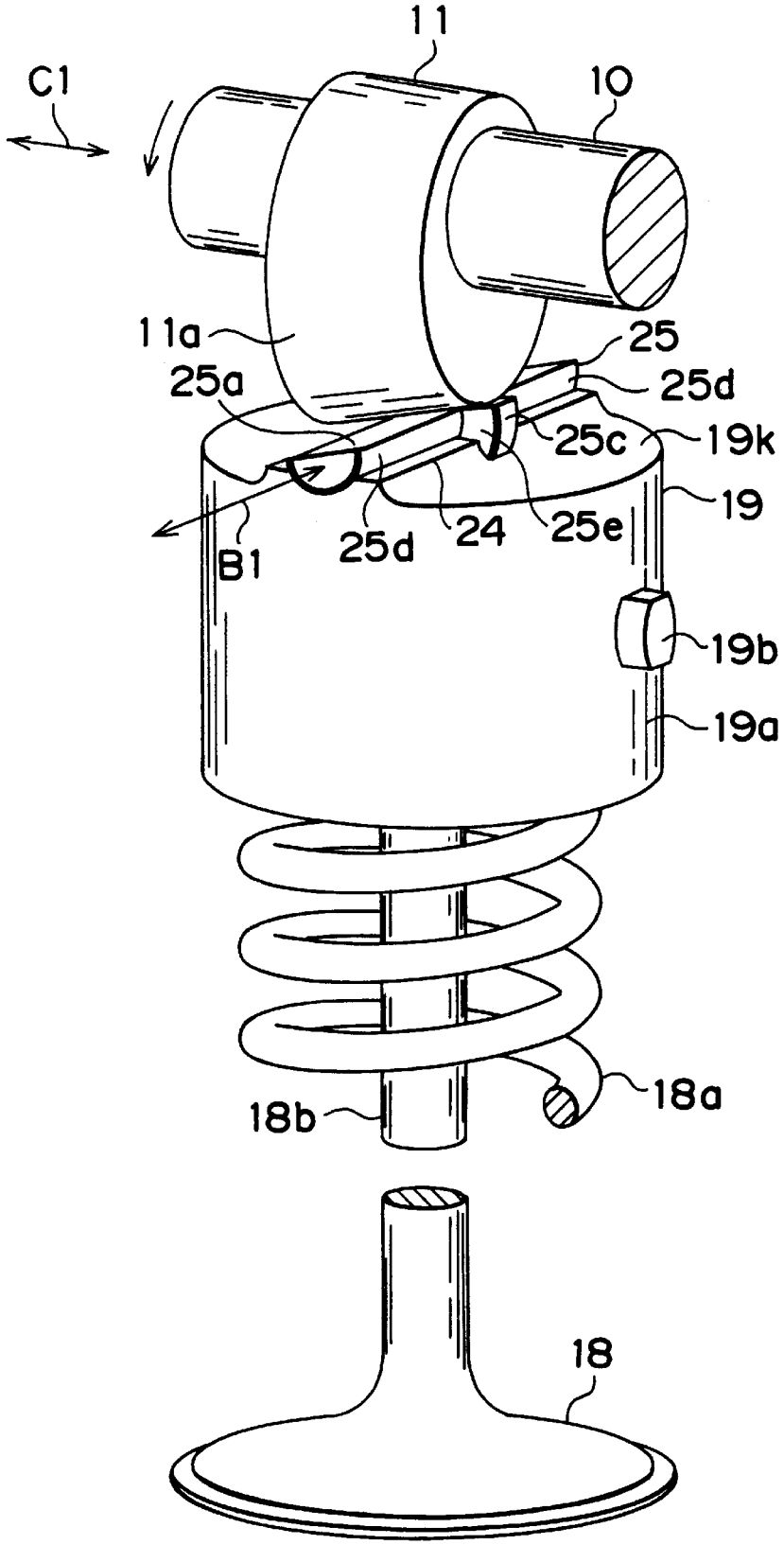
FIG. 3 is a perspective view of the variable valve operating apparatus for the three-dimensional cam of the first embodiment.
Figure 4:
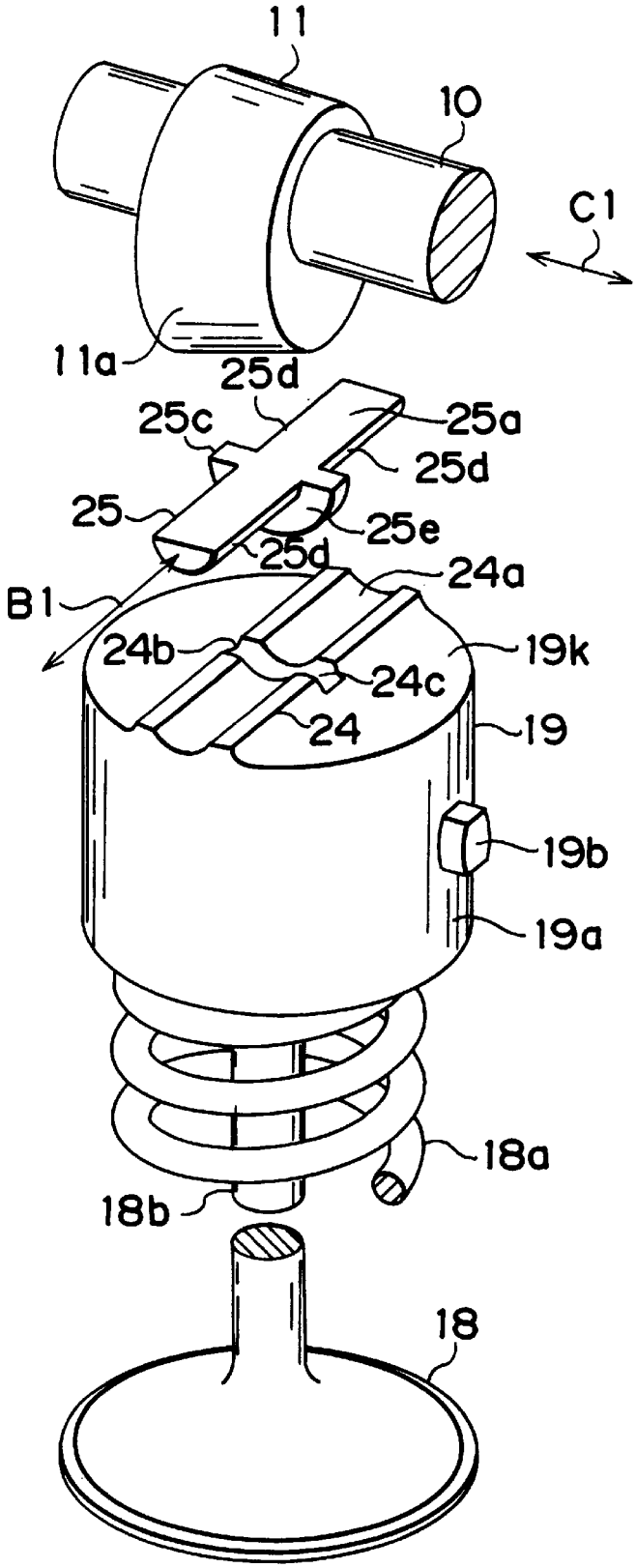
FIG. 4 is an exploded perspective view of the variable valve operating apparatus of the three-dimensional cam of the first embodiment.

As shown in an enlarged view of FIG. 3 and an exploded perspective view of FIG. 4, the valve lifter 19 is formed to a cylindrical shape and provided with a detent projection 19*b* at its outer peripheral surface 19*a*. As shown in a vertical sectional view of FIG. 5, the projection 19*b* is inserted into a detent groove 9*b* provided in an inner peripheral surface of a lifter bore 9*a* formed in the cylinder head 9. In this structure, the projection 19*b* and the groove 9*b* constitute a detent mechanism such that the valve lifter 19 is guided non-rotatively in the lifter bore 9*a* and slidably in the axial direction thereof.

Figure 6A:
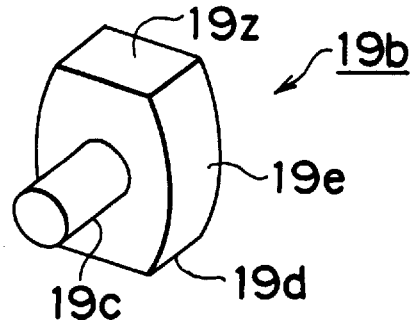
FIGS. 6A to 6E are views for explaining a structure of a projection serving as a detent used in the first embodiment.
Figure 6B:
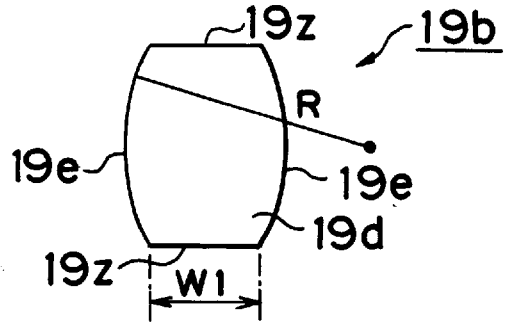
Figure 6C:
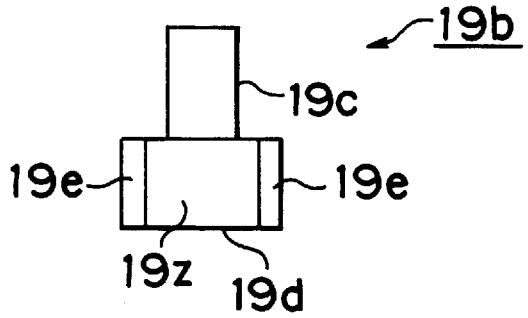
Figure 6D:
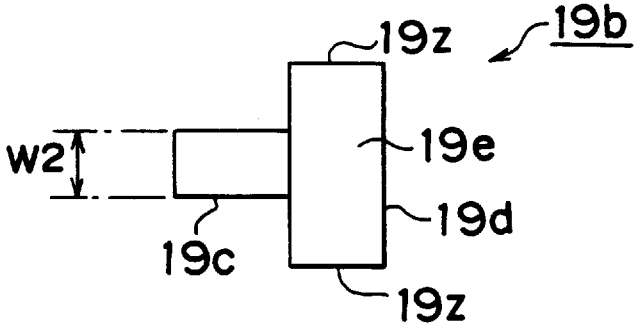
Figure 6E:
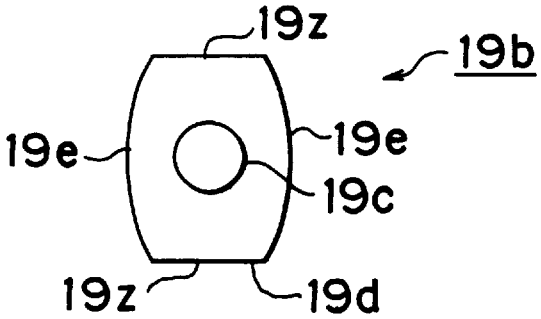

As shown in a perspective view of FIG. 6A, a front view of FIG. 6B, a plan view of FIG. 6C, a left side view of FIG. 6D and a rear elevation view of FIG. 6E, the projection 19*b* is formed of a cylindrical force fit portion 19*c* and a substantially rectangular parallelepiped projecting portion 19*d*. The cylindrical force fit portion 19*c* is force fitted into a force fit hole 19*g* formed by piercing the valve lifter 19 from the outer peripheral surface 19*a* to the inner peripheral surface 19*f* thereof. With this structure, the projecting portion 19*d* formed on one end of the force fit portion 19*c* is disposed to project from the outer peripheral surface 19*a* of the valve lifter 19.

Among the surfaces of the projecting portion 19*d*, opposite side surfaces 19*e* facing side surfaces 9*c* of the detent groove 9*b* are not flat but are curved with large radii R. For example, if the width of the detent groove 9*b* is 6 mm, the projecting portion 19*d* is convexly curved with R equal to 30 mm or greater.

Figure 7:
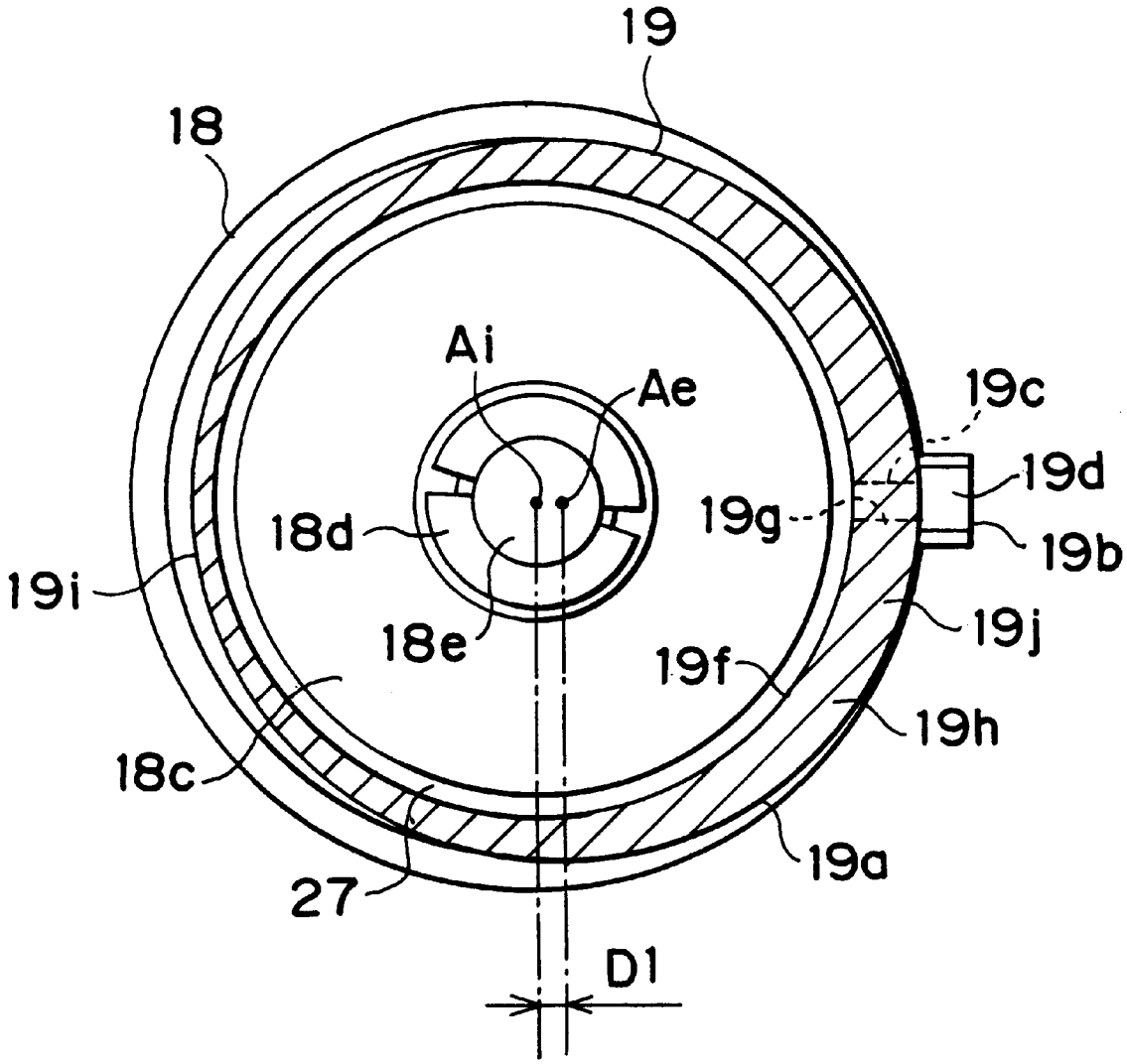
FIG. 7 is a sectional view of the variable valve operating apparatus of the three-dimensional cam of the first embodiment taken along line 7—7 in FIG. 5.

As shown in a transverse sectional view of FIG. 7 (taken along line 7—7 in FIG. 5), the center axis Ae of the cylindrical outer peripheral surface 19*a* does not coincide with the center axis Ai of the cylindrical inner peripheral surface 19*f*, resulting in an offset D1. With this offset D1, a peripheral wall 19*h* of the valve lifter 19 is formed at one side in the offset direction with a thin wall portion 19*i* which is thinnest, and at the opposite side with a thick wall portion 19*j* which is the thickest.

The thick wall portion 19*j* has a force fit hole 19*g* pierced from the outer peripheral surface 19*a* to the inner peripheral surface 19*f* for fixing the projection 19*b*. Therefore, the projection 19*b* projects from the outer peripheral surface 19*a* at the position of the thick wall portion 19*j*.

The valve lifter 19 is integrally formed at its top surface 19*k* with a cam follower holder 24 (FIG. 3), and a cam follower 25 (corresponding to a rocking follower) is rockably supported in the cam follower holder 24 and swingable in the widthwise direction. The valve lifter 19 is biased toward the intake cam 11 by a spring 18*a* disposed between the valve lifter 19 and the cylinder head 9 under compression. Therefore, cam sliding surface 25*a* of the cam follower 25 is pushed toward a cam surface 11*a* of the intake cam 11 and brought into sliding contact with the cam surface 11*a*, and the cam follower 25 rocks accordance with the cam surface 11*a*.

Figure 8A:
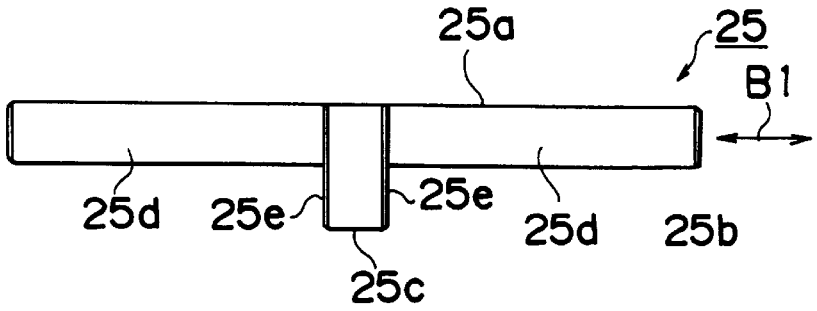
FIGS. 8A to 8D are views for explaining a structure of a cam follower used in the first embodiment.
Figure 8B:
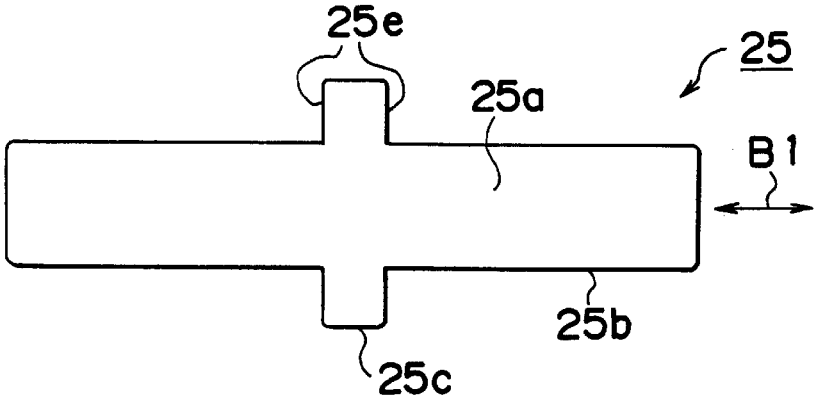
Figure 8C:
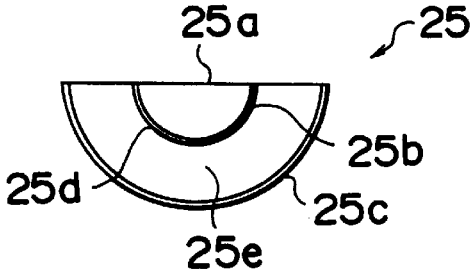
Figure 8D:
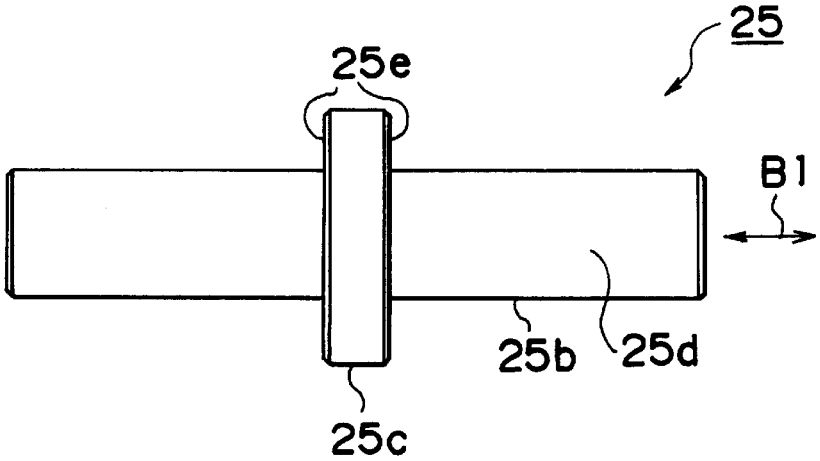

As shown in the exploded perspective view of FIG. 4, a front view of FIG. 8A, a plan view of FIG. 8B, a right side view of FIG. 8C and a bottom view of FIG. 8D, the cam follower 25 includes a semicolumnar body 25*b* and a wide portion 25*c* provided at the central of the body 25*b* in the rocking direction (in the direction of the arrow B1 in FIGS. 4, 8A, 8B and 8D) having a diameter larger than that of the body 25*b*. When a cylindrical outer peripheral surface of the body 25 is disposed in the cam follower holder 24 of the valve lifter 19 as shown in FIG. 3, the cylindrical outer peripheral surface serves as a sliding surface 25*d* which slides on a guide groove 24*a* having a semicircular section formed in the cam follower holder 24 at the time when the cam follower 25 rocks.

The wide portion 25*c* of the cam follower 25 is accommodated in a wide groove 24*b* formed at the central portion (central portion in the direction of the arrow B1 in FIG. 4) of the guide groove 24*a* corresponding to the wide portion 25*c*. With this structure, as a thrust surface 25*e* of the wide portion 25*c* abuts against a thrust surface 24*c* of the wide groove 24*b*, it is possible to prevent the cam follower 25 from moving in the direction of the rocking axis shown by the arrow B1. That is, the cam follower 25 disposed in the cam follower holder 24 of the valve lifter 19 is capable of rocking about the rocking axis, but is not allowed to move in the direction of the rocking axis.

The cam follower holder 24 is formed on the top surface 19*k* of the valve lifter 19 such that the direction of the rocking axis (the direction of the arrow B1) of the cam follower 25 is perpendicular to the aforementioned offset direction. Further, the cam follower holder 24 is disposed at the central portion of the circular top surface 19*k*. With this structure, as shown in a plan view of FIG. 9 (intake cam 11 is omitted in the drawing), the central portion of the cam follower 25 exists on a center axis Ae of the outer peripheral surface 19*a*, and the direction of the rocking axis (the direction of the arrow B1 in the drawing) of the cam follower 25 is disposed perpendicular to the center axis Ae.

Figure 9:
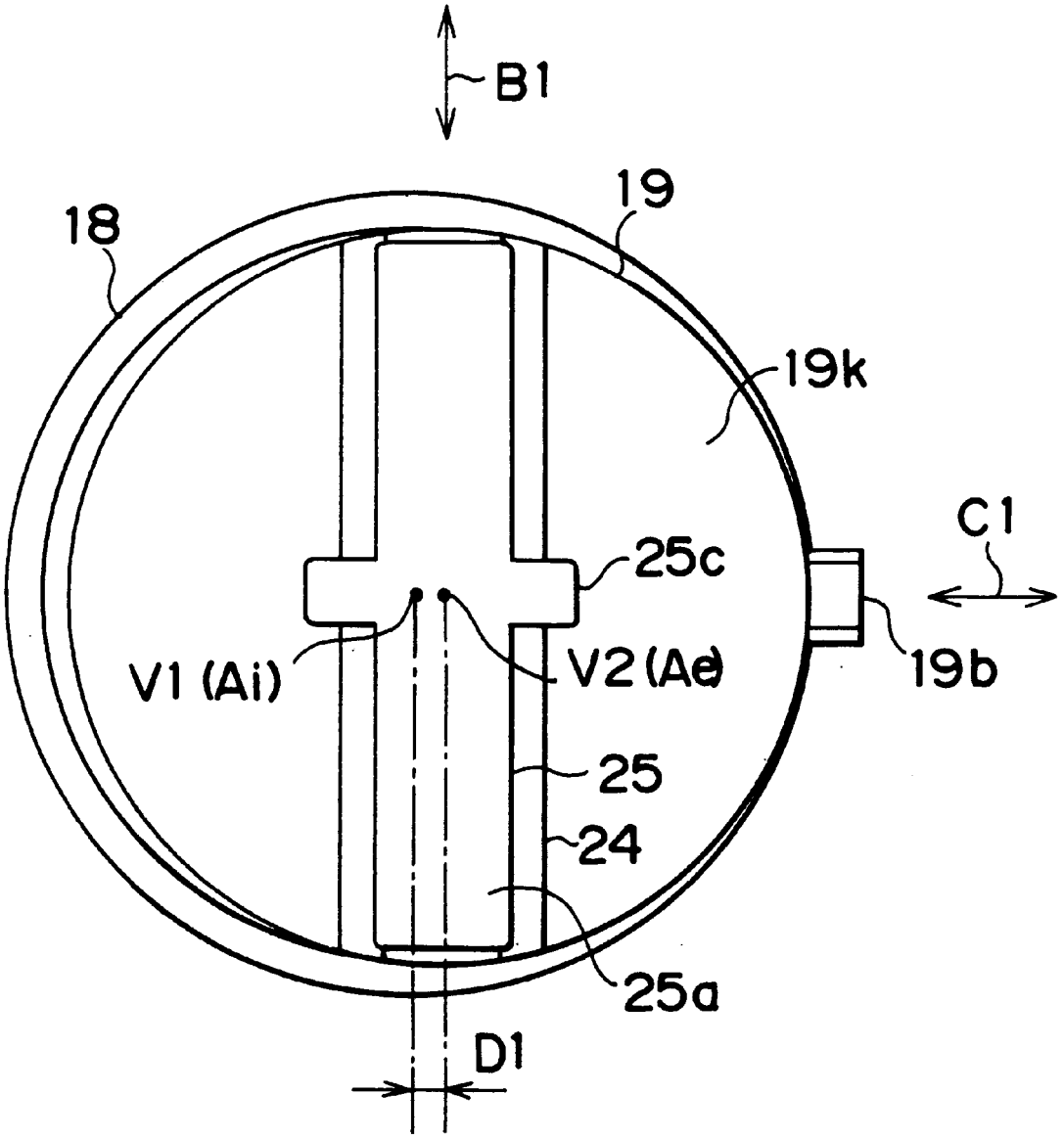
FIG. 9 is a plan view of the variable valve operating apparatus of the three-dimensional cam of the first embodiment.

The inner peripheral surface 19*f* forms an outer periphery of an accommodation chamber 27 in which a valve stem 18*b*, a spring 18*a*, a retainer 18*c* and a valve cotter 18*f* of the intake valve 18 are accommodated. Center axes of the valve stem 18*b* and the spring 18*a* coincide with the center axis Ai of the inner peripheral surface 19*f*. Therefore, as shown in FIG. 9, the aforementioned offset D1 exists between the center V2 of the cam follower 25 and the center V1 where a stem end 18*e* which as the upper end of the valve stem 18*b* abuts against the valve lifter 19 from below.

Figure 5:
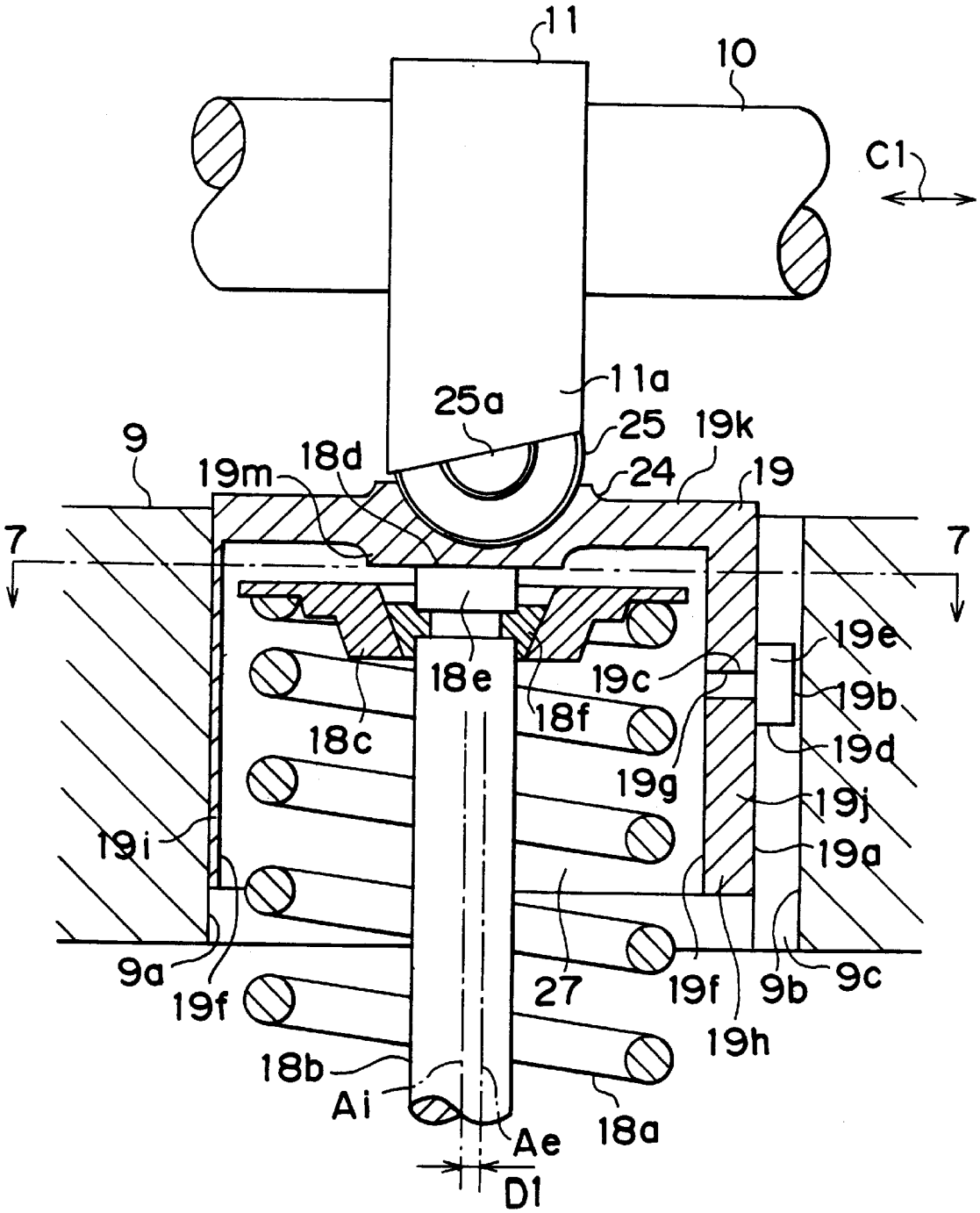
FIG. 5,is a vertical sectional view of the variable valve operating apparatus of the three-dimensional cam of the first embodiment.

A leading end surface 18*d* of the stem end 18*e* abuts against a lower surface (reference surface) of a projection 19*m* existing on a back side of the top surface 19*k* (see FIG. 5). With this structure, variation in the lift amount of the cam surface 11*a* by the rotation of the intake cam 11 can precisely be reflected to the opening degree of the intake valve 18 itself through the cam follower 25 and the valve lifter 19.

According to the aforementioned first embodiment, a spatial room enough to form the thick wall portion 19*j* is generated by the offset D1 between the cylindrical outer peripheral surface 19*a* of the valve lifter 19 and the accommodation chamber 27 (corresponding to an interior of the inner peripheral surface 19*f*) in which the stem end 18*e* and the like are accommodated. Further, the thickness of the valve lifter is gradually reduced the farther away from the thick wall portion 19*j*. The thickness of the thin wall portion 19*i* is extremely thin. Therefore, the weight of the valve lifter 19 is not increased as a whole, or can be further reduced by sufficiently reducing the thickness except the thick wall portion 19*j*. Therefore, the projection 19*b* can be mounted on the thick wall portion 19*j* by a force fit, which is a simple process. Further, since the inner peripheral surface 19*f* may be of a cylindrical shape, the lifter can be easily worked.

Furthermore, since the thick wall portion 19*j* having sufficient thickness can be formed, it is possible to mount the projection 19*b*, which is sufficiently large, without generating deformation of the valve lifter 19. Therefore, the area contacting the detent groove 9*b* formed in the cylinder head 9 is increased, the surface pressure can be reduced, and thus the durability can be improved.

Further, since the thick wall portion 19*j* exists longer in the axial direction of the valve lifter 19, the detent mechanism can be formed on the outer peripheral surface 19*a* of the valve lifter 19 instead of the top surface 19*k*. Therefore, the design freedom of the detent mechanism can be improved.

The offset D1 is provided in the direction of the rotation axis of the intake cam 11 (the direction of the arrow C1 in the drawing), and the positions of the intake cam 11 and the cam follower 25 coincide with the center axis Ae of the outer peripheral surface of the valve lifter 19. With this structure, the length of the cam follower 25 can be equal to the diameter of the outer peripheral surface 19*a*. That is, the cam follower 25 can assume the maximum length on the top surface 19*k*. Therefore, it is possible to secure a sufficient region where the cam surface 11*a* of the intake cam 11 can slide in a direction (the same direction as the direction B1) perpendicular to the direction of the rotation axis. Therefore, it is possible to increase the height of a cam nose of the intake cam 11, and to increase the lift amount and the lifting speed.

Furthermore, since the intake cam 11 and the cam follower 25 are separated from the center axis Ai of the valve stem 18*b* in the present embodiment, the intake cam 11 can be disposed away from a journal bearing 22 existing at the side of the intake valve 18. Therefore, it is possible to increase the moving amount of the intake cam 11 in the direction of the rotation axis, and variation of the lift amount is further increased, and the variation pattern can further be diversified.

Further, in the projecting portion 19*d* of the projection 19*b*, side surfaces 19*e* facing the side surfaces 9*c* of the detent groove 9*b* are formed into an arcuate convex shape having a predetermined radius of curvature R. With this structure, as compared with the case where the side surfaces 19*e* are formed straight, it is possible to prevent the angled portions at upper and lower ends of the projecting portion 19*d* from contacting with the opposed side surfaces 9*c* of the groove 9*b* when the valve lifter 19 is cocked. Therefore, it is possible to maintain the contacting surface pressure at a low level to-prevent abnormal abrasion, and to improve the durability of the detent mechanism.

A second embodiment of the invention will be described.

Figure 10:
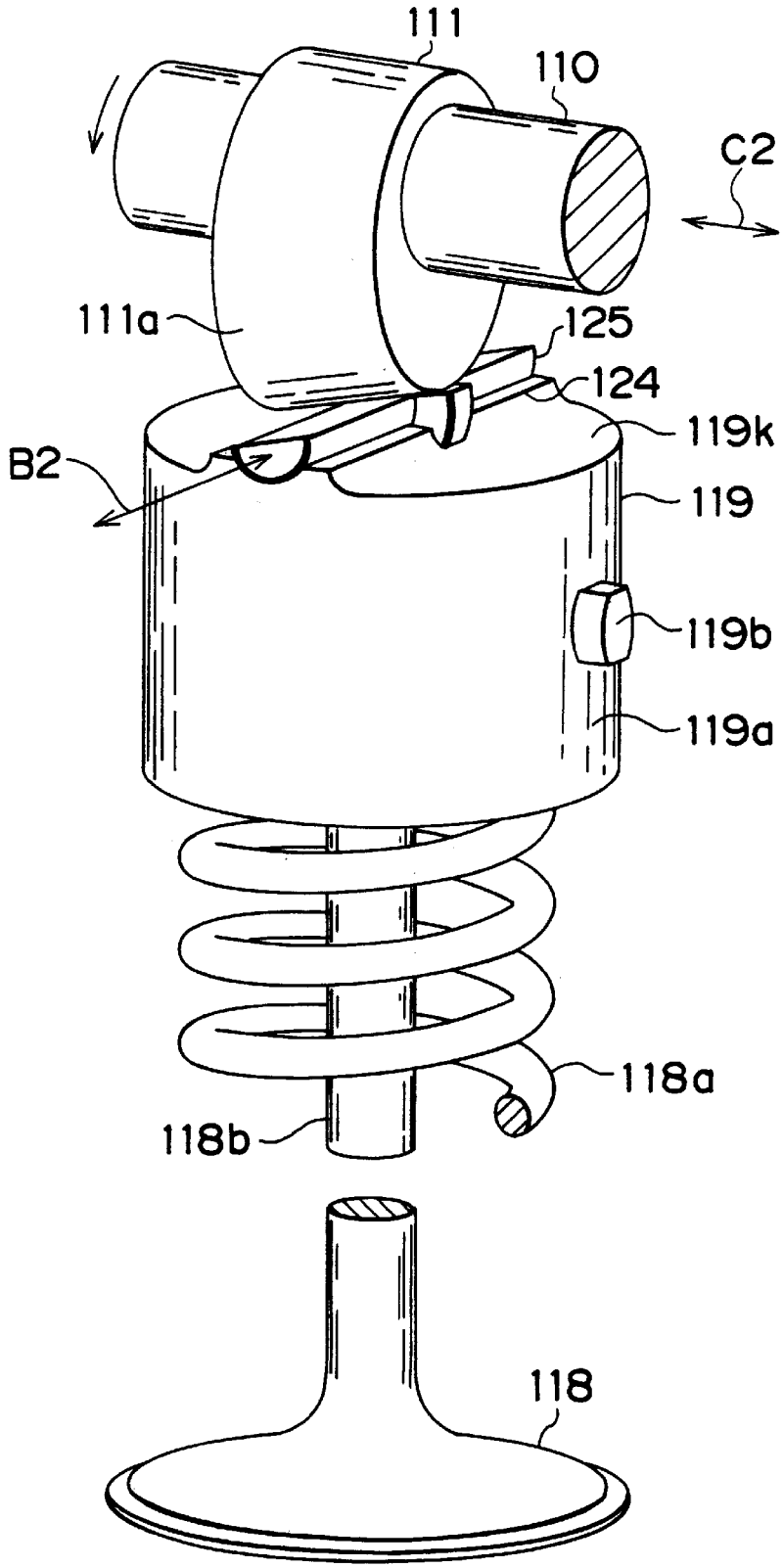
FIG. 10 is a perspective view of a variable valve operating apparatus for a three-dimensional cam of a second embodiment.
Figure 11:
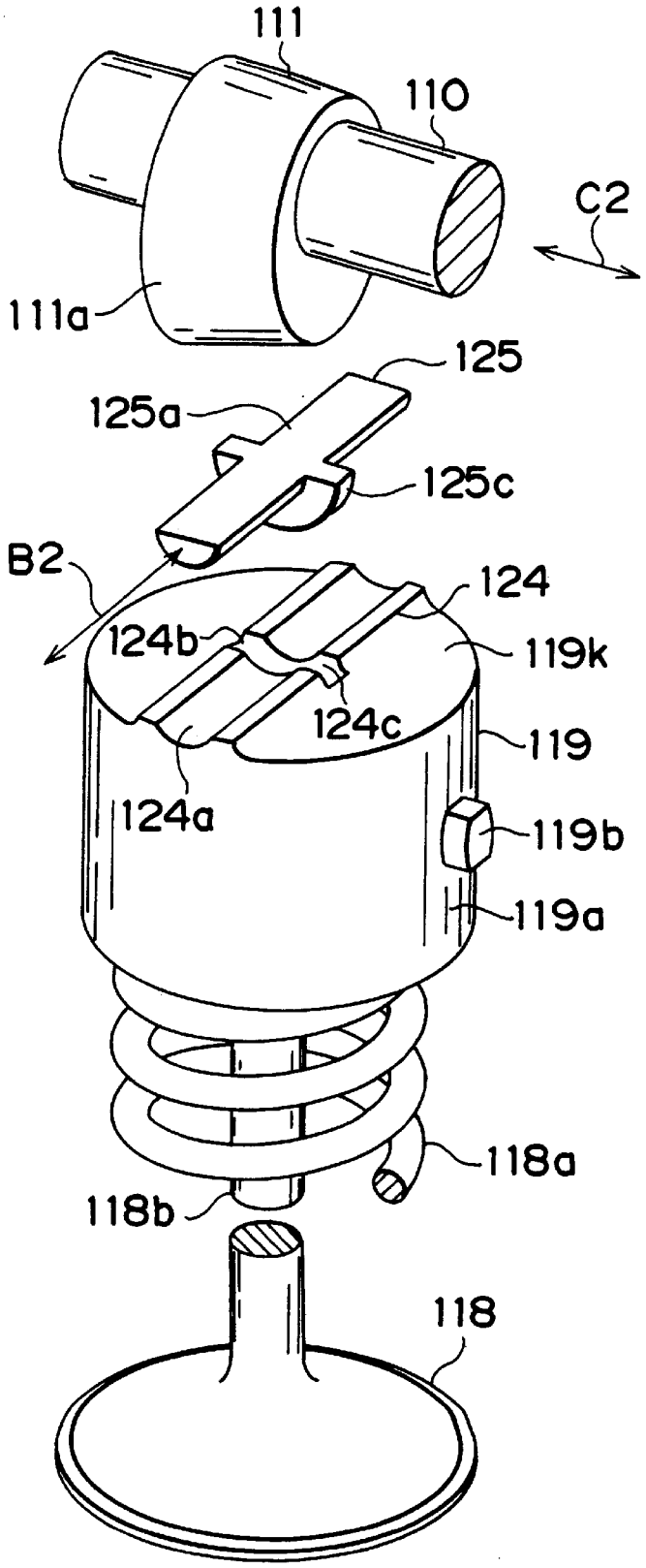
FIG. 11 is an exploded perspective view of the variable valve operating apparatus of the three-dimensional cam of the second embodiment.
Figure 12:
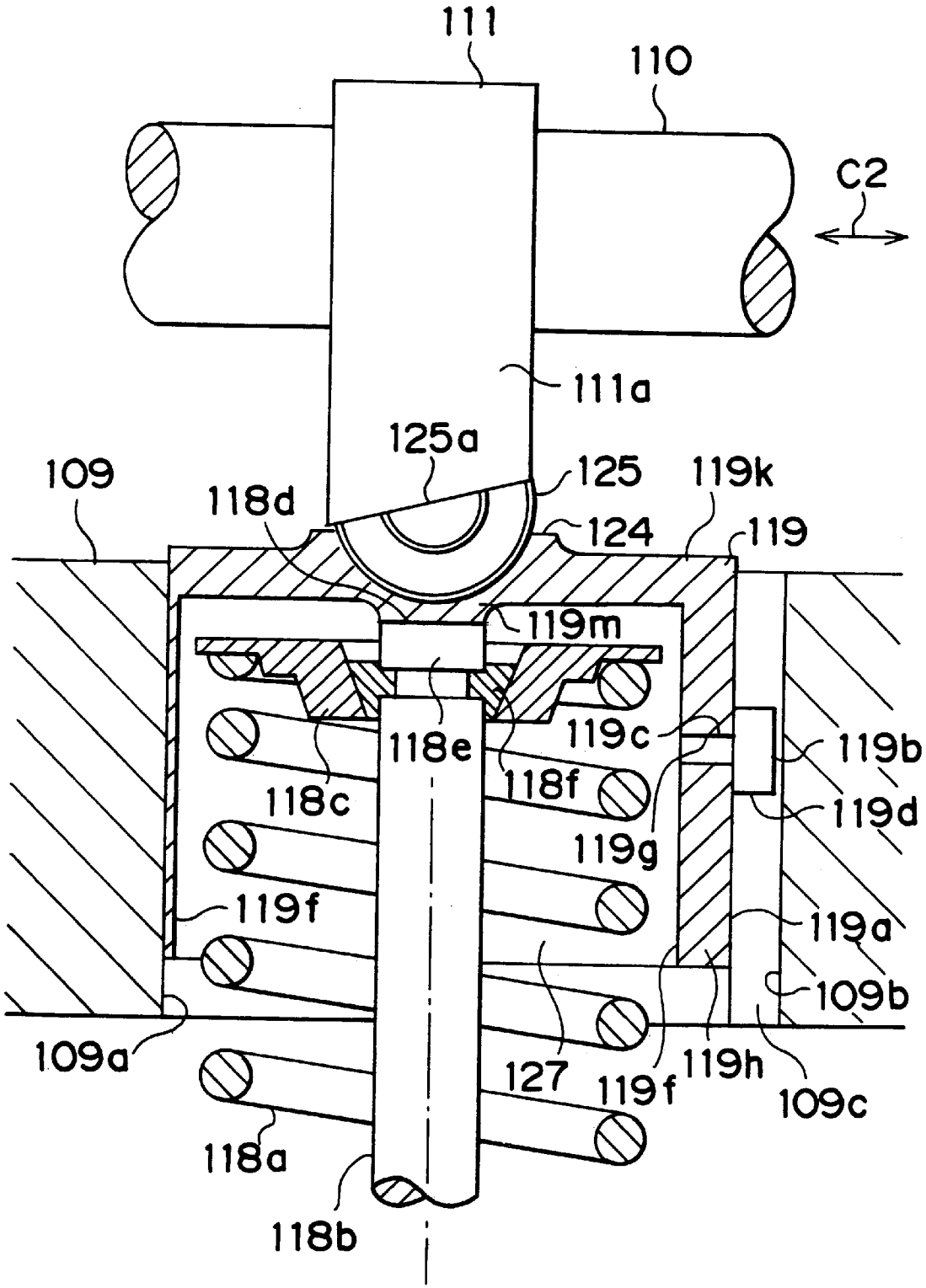
FIG. 12 is a vertical sectional view of the variable valve operating apparatus of the three-dimensional cam of the second embodiment.
Figure 13:
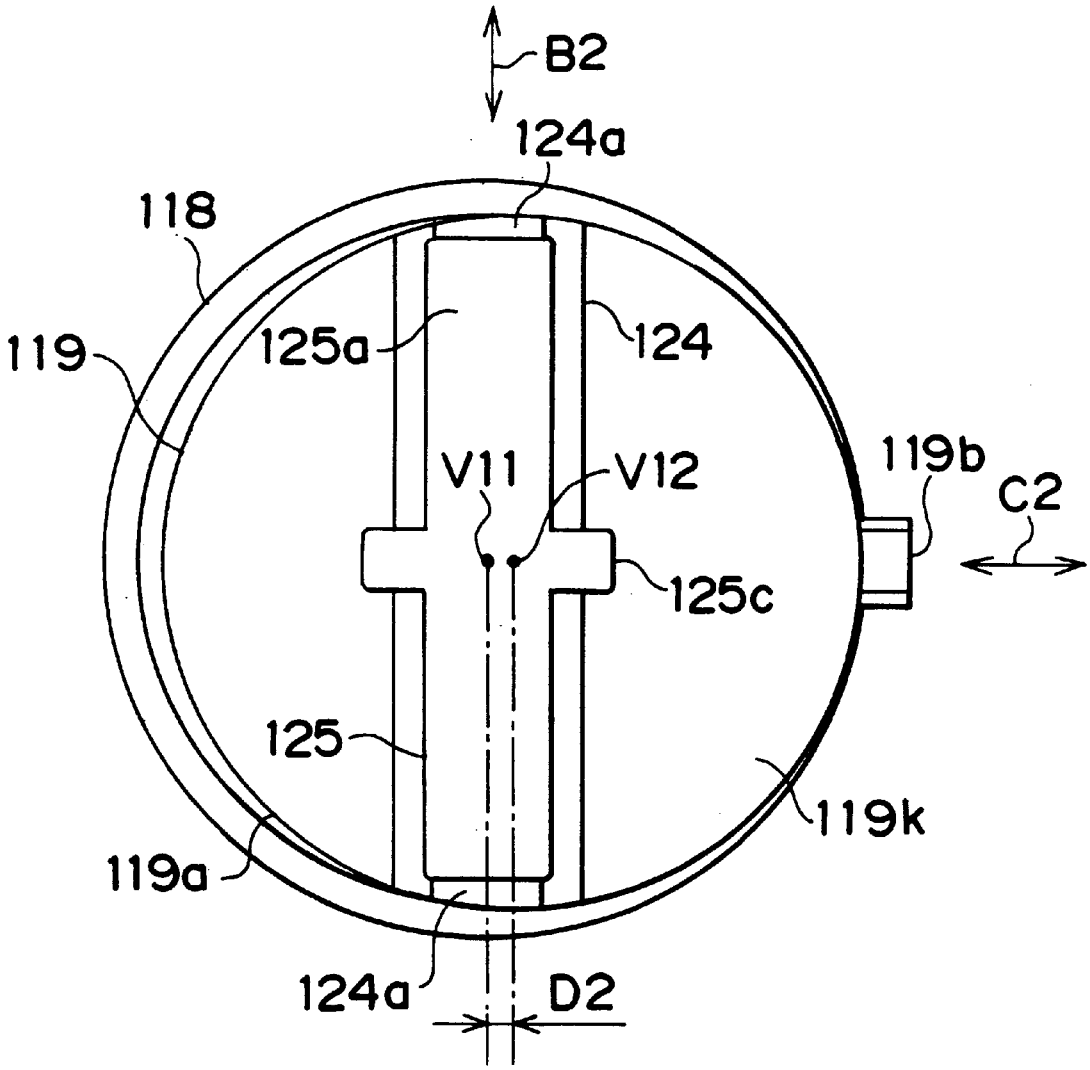
FIG. 13 is a plan view of the variable valve operating apparatus of the three-dimensional cam of the second embodiment.

FIGS. 10 and 11 respectively show a perspective view and an exploded perspective view of essential portions of a valve lifter 119 and a variable valve operating apparatus of the second embodiment. FIG. 12 is a vertical sectional view of an intake cam 111 in its axial direction (the direction of the arrow C2 in the drawings) and FIG. 13 is a plan view (the intake cam 111 is omitted). Elements having the same functions as those of the first embodiment are designated as the number obtained by adding 100 to those of the first embodiment.

The present second embodiment is the same as the aforementioned first embodiment in that an outer peripheral surface 119*a* and an inner peripheral surface 119*f* of a valve lifter 119 are offset by D2 in an axial direction of an intake cam 111. However, the amount of the offset D2 is not necessarily the same as D1.

As shown in FIG. 12, the second embodiment is different from the first embodiment in that the center of a cam follower holder 124 is formed on the center axis (same as the center axis V11 of the inner peripheral surface 119*f*) of a valve stem 118*b*.

That is, in the first embodiment, the center of the cam follower holder 24 is disposed on the center of the top surface 19*k* of the valve lifter 19. However, as shown in FIG. 13, centers of a cam follower holder 124 and a cam follower 125 of the second embodiment exist on the center axis (V1) of the valve stem 118*b*.

Since the cam follower holder 124 is disposed at a position offset from the center position (position on a center axis V12 of the outer peripheral surface 119*a*) of the top surface 119*k* in this manner, a guide groove 124*a* of the cam follower holder 124 is shortened, and the length of the cam follower in a direction of its rocking axis (the direction of the arrow B2 in the drawing) of the cam follower 125 is shortened correspondingly.

According to the aforementioned second embodiment, the offset D2 is in the direction of the rotation axis of the-intake cam 111, and the center positions of the intake cam 111 and the cam follower 125 are disposed on the center 15 axis (V11) of the valve stem 118*b*. Therefore, it does not have to strengthen the rigidity of the top surface 119*k* of the valve lifter 119 over a wide range. For this reason, as shown in FIG. 12, the projection 119*m* existing on the back side of the top surface 119*k* has a diameter smaller than that of the first embodiment. Since the rigidity may be maintained in a narrow range among the intake cam 111, the cam follower 125 and the stem end 118*e* in this manner, the diameter of the projection 119*m* can be reduced, and the weight of the valve lifter 119 can further be reduced.

Further, a lift force transmitting path among the intake cam 111, the cam follower 125, the valve lifter 119 and the stem end 118*e* becomes linear. Therefore, even by the pressure or impact force due to the rotation of the intake cam 111, the lift force transmitting path is hardly deformed. Thus, the weight of the valve lifter 119 is further reduced, and it is possible to adjust the valve lift amount more precisely.

Although the centers of the intake cam and the cam follower coincide with the center axis of the valve stem in the second embodiment, the centers of the intake cam and the cam follower may be disposed anywhere within a region between the center axis of the outer peripheral surface of the valve lifter and the center axis of the valve stem.

A third embodiment of the invention will be described.

Figure 14:
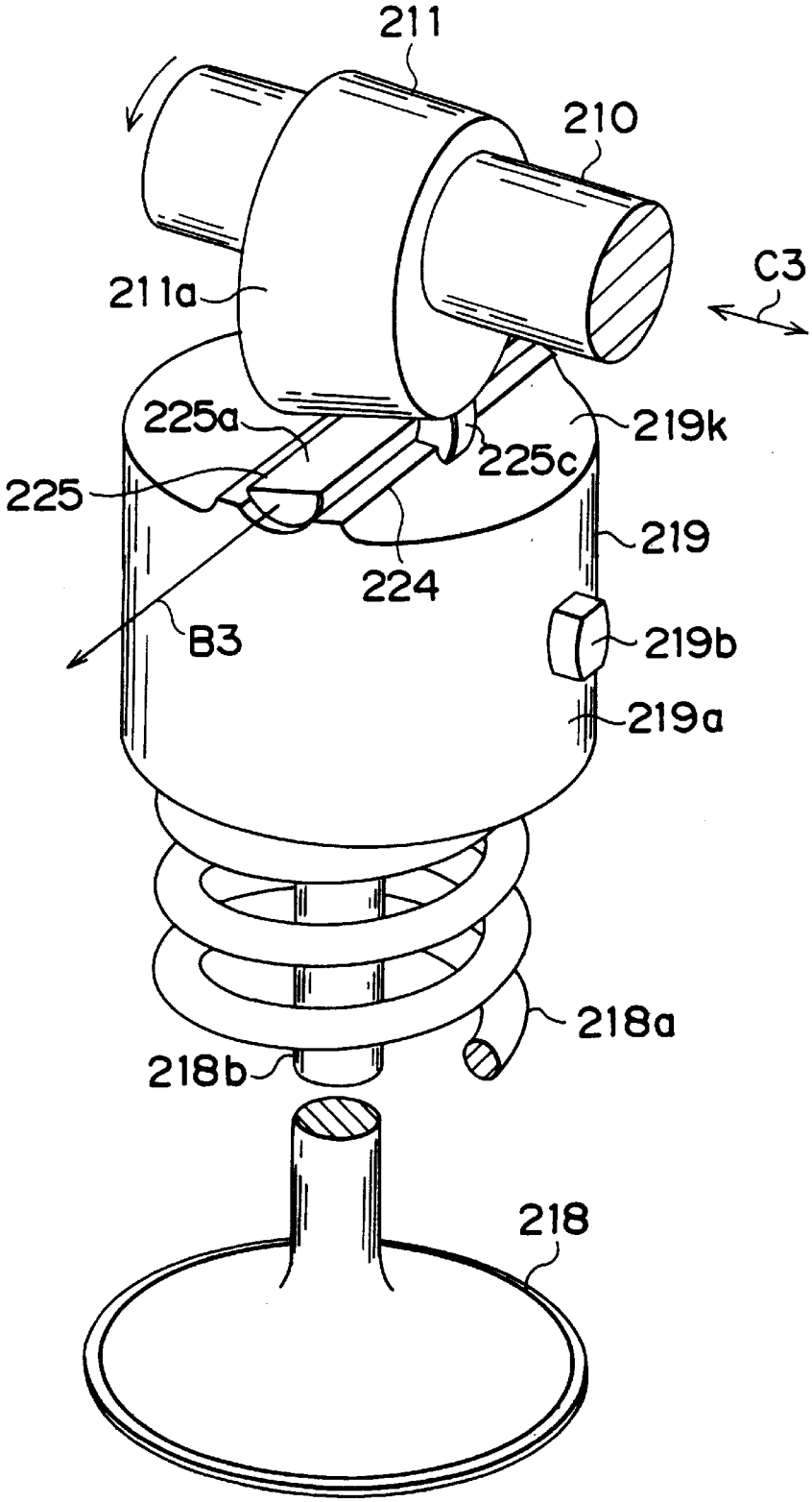
FIG. 14 is a perspective view of a variable valve operating apparatus of a three-dimensional cam of a third embodiment.
Figure 15:
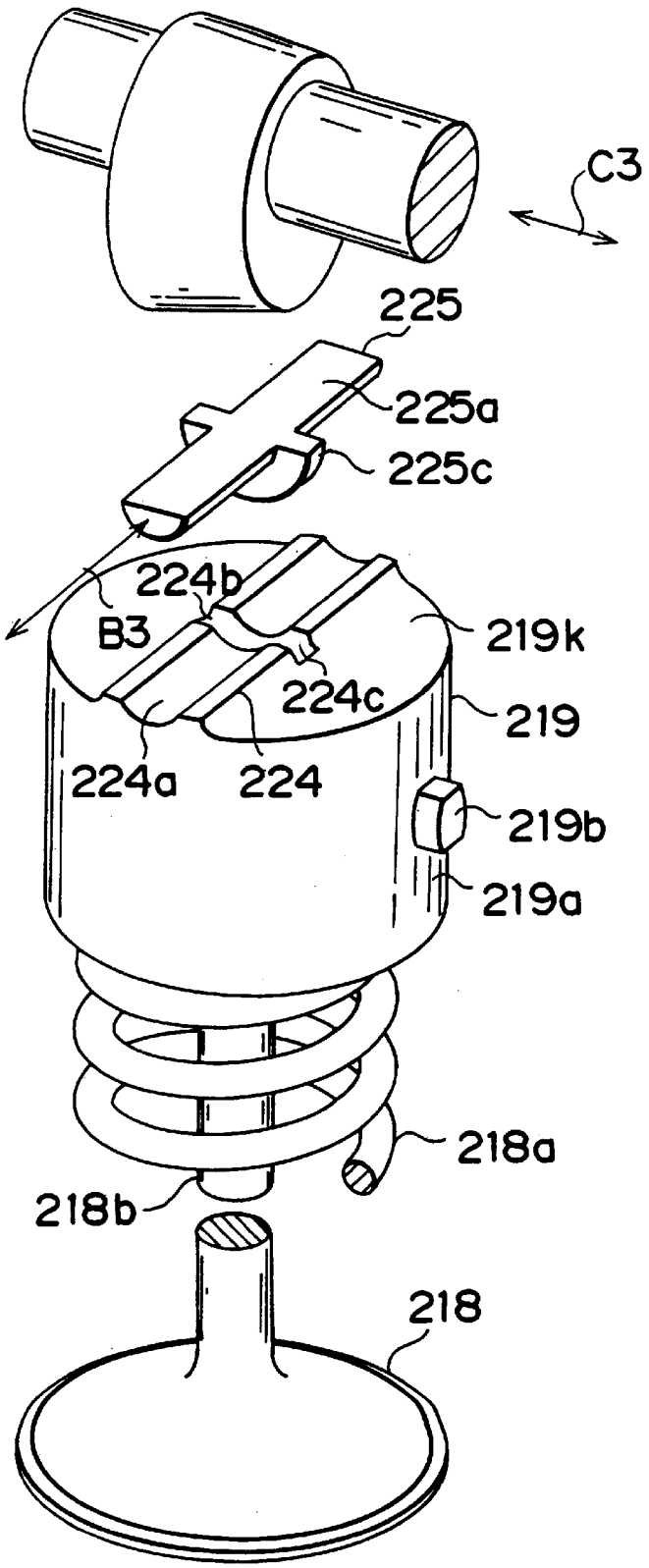
FIG. 15 is an exploded perspective view of the variable valve operating apparatus of the three-dimensional cam of the third embodiment.
Figure 16:
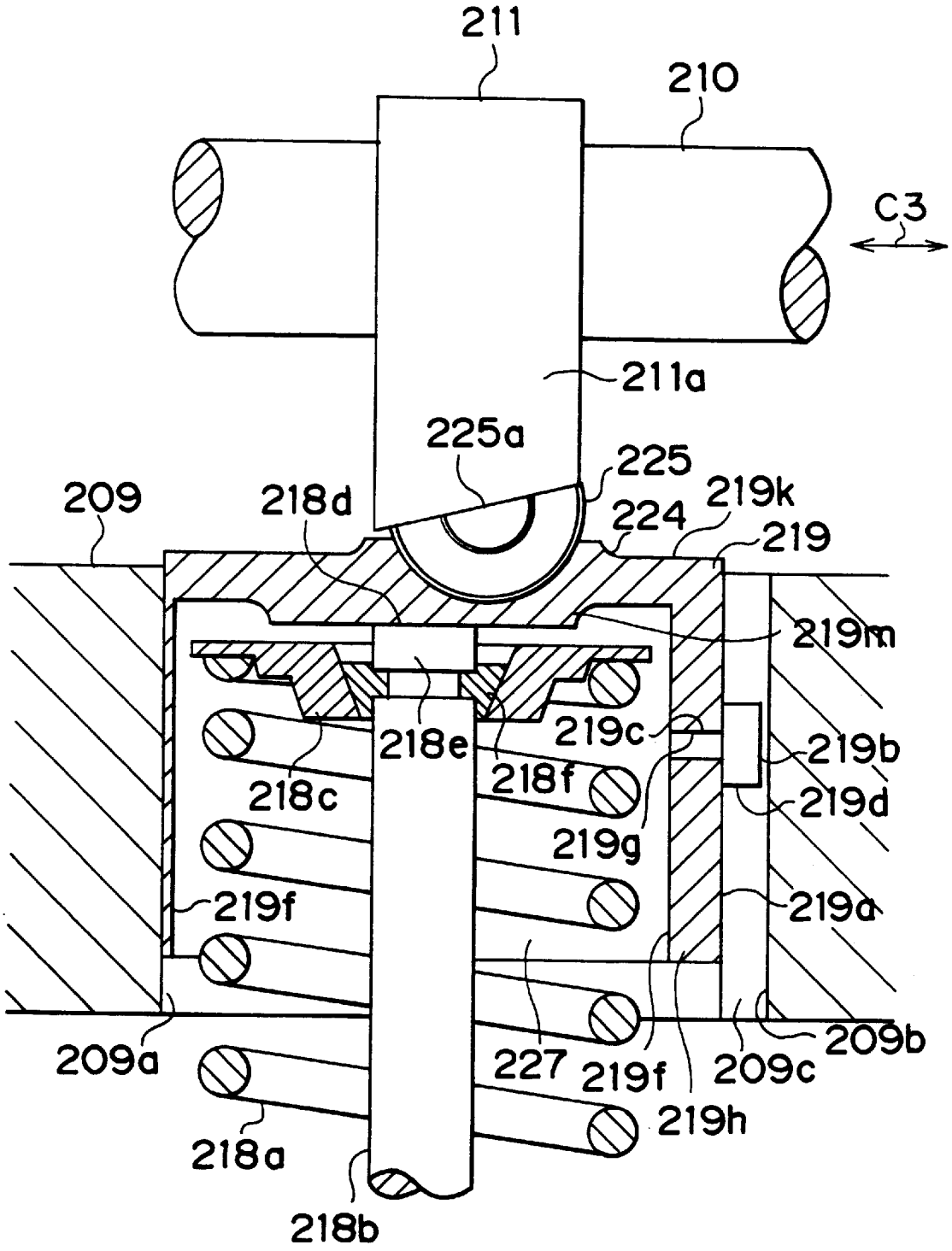
FIG. 16 is a vertical sectional view of the variable valve operating apparatus of the three-dimensional cam of the third embodiment.
Figure 17:
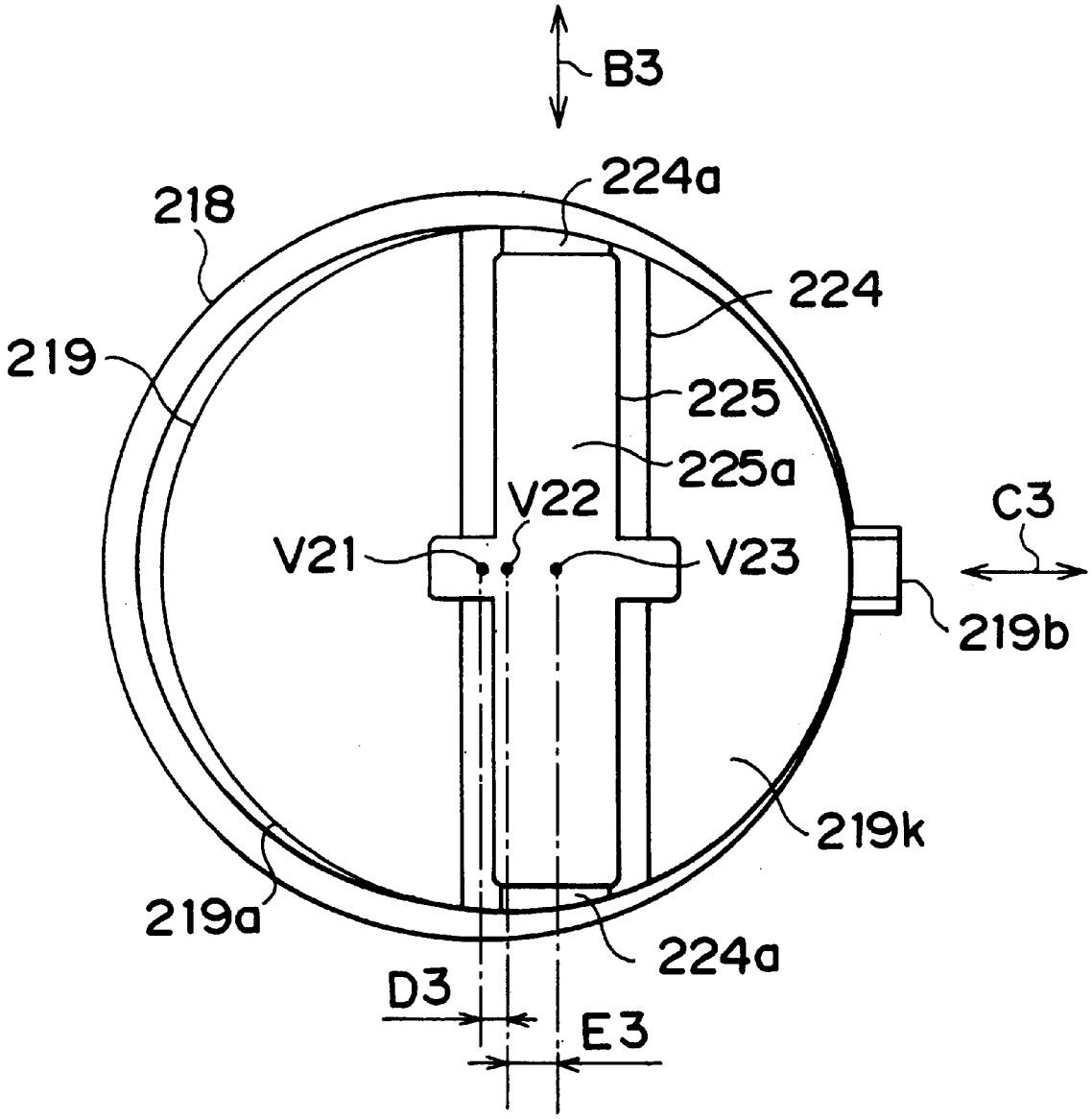
FIG. 17 is a plan view of the variable valve operating apparatus of the three-dimensional cam of the third embodiment.

FIGS. 14 and 15 respectively show a perspective view and an exploded perspective view of essential portions of a valve lifter 219 and a variable valve operating apparatus of the third embodiment. FIG. 16 is a vertical sectional view of an intake cam 211 in its axial direction (the direction of the arrow C3 in the drawing), and FIG. 17 is a plan view (the intake cam 211 is omitted). Elements having the same functions as those of the first embodiment are designated with reference numbers obtained by adding 200 to those of the first embodiment.

The third embodiment is the same as the aforementioned first and second embodiments in that an outer peripheral surface 219*a* and an inner peripheral surface 219*f* of a valve lifter 219 are offset by D3 in an axial direction of an intake cam 211. However, the amount of the offset D3 is not always the same as D1 or D2.

As shown in FIGS. 16 and 17, the third embodiment is different from the first embodiment in that the center position V23 of the cam follower holder 224 is formed at a side opposite from a center axis (same as the center axis V21 of an inner peripheral surface 219*f*) of a valve stem 218*b* with respect to the center axis V22 of the outer peripheral surface 219*a*.

That is, in the first embodiment, the center of the cam follower holder 24 is disposed on the center of the top surface 19*k* of the valve lifter 19, and due to this structure, the cam follower 25 is also disposed on the center of the top surface 19*k* of the valve lifter 19. However, as shown in FIGS. 16 and 17, the centers of a cam follower holder 224, and a cam follower 225 of the third embodiment are offset by E3 to the opposite side of a valve stem 218*b* in an axial direction of an intake cam 211 with respect to a valve lifter 219. With this structure, the center axis V23 of the cam follower holder 224 and the cam follower 255 are greatly separated from the center axis (V21) of the valve stem 218*b*.

Since the cam follower holder 224 is disposed at a position offset from the center position (position on the center axis V22 of an outer peripheral surface 219*a*) of the top surface 219*k* in this manner, a guide groove 224*a* of the cam follower holder 224 is shortened, and the length of the cam follower 225 in its rocking direction (the direction of the arrow B3 in the drawing) is also shortened correspondingly.

According to the aforementioned third embodiment, the intake cam 211 and the cam follower 225 are greatly separated from the center axis (V21) of the valve stem 218*b*. Therefore, it is possible to further separate the intake cam 211 existing at the side of the intake valve 218 from a journal bearing. Thus, the moving amount of the intake cam 211 in the direction of its rotation axis can further be increased, the variation of the lift amount can further be increased, and the variation pattern can further be diversified.

A fourth embodiment of the invention will be described.

Figure 18:
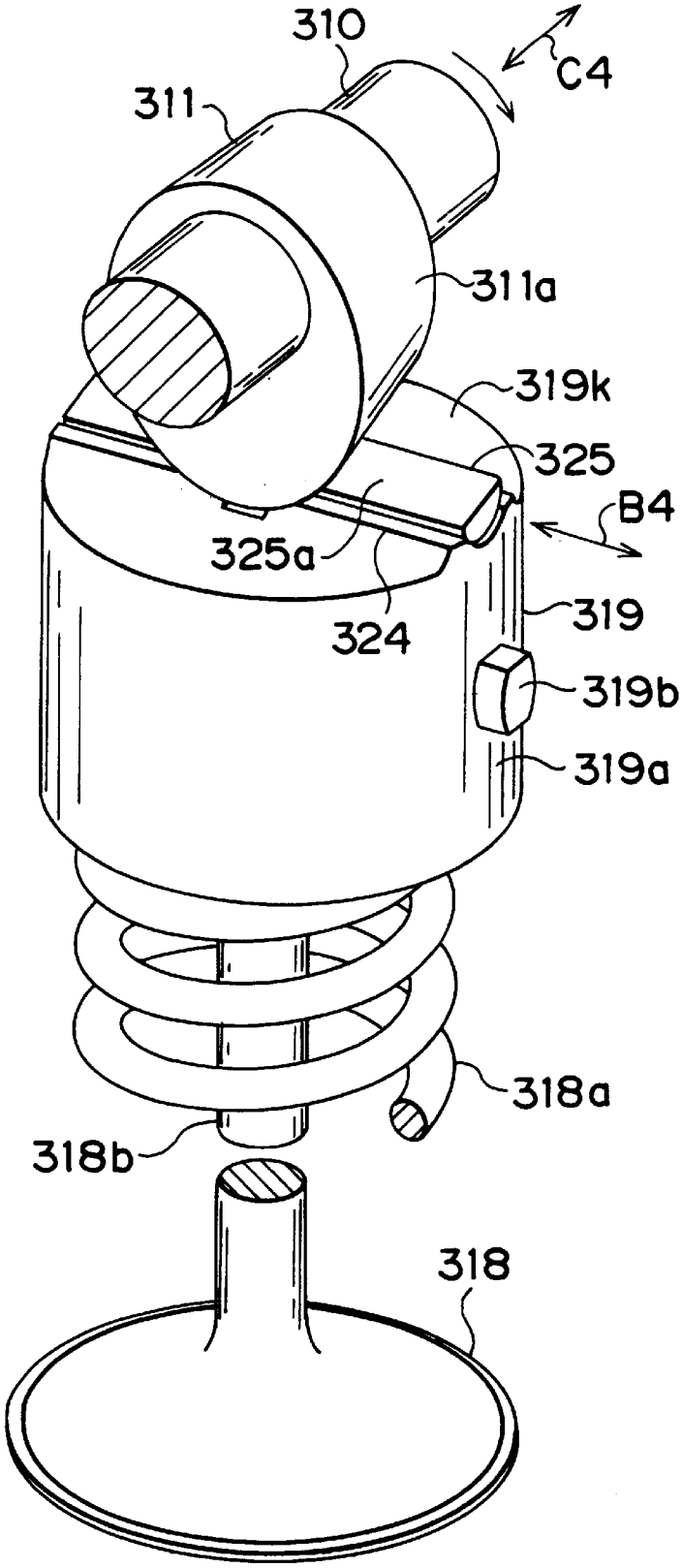
FIG. 18 is a perspective view of a variable valve operating apparatus of a three-dimensional cam of a fourth embodiment.
Figure 19:
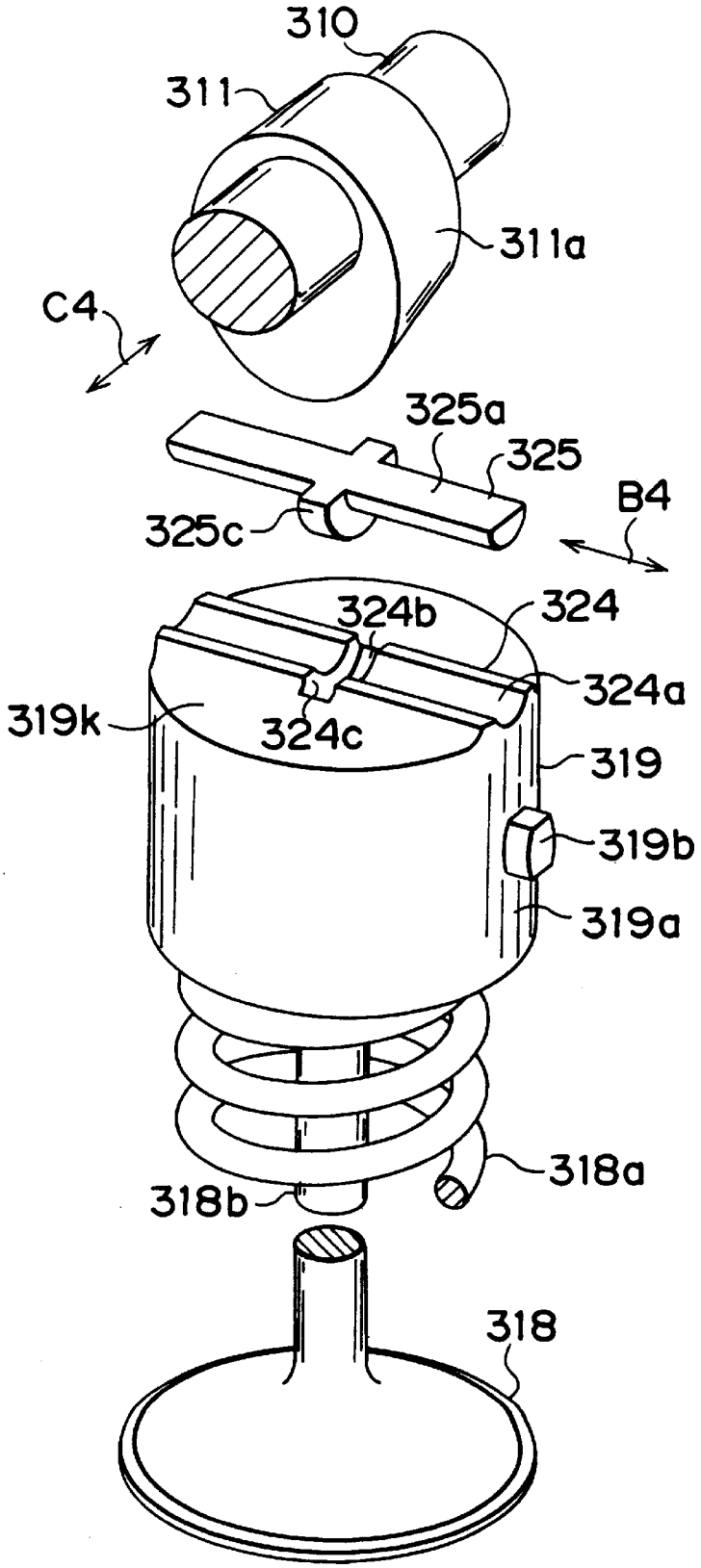
FIG. 19 is an exploded perspective view of the variable valve operating apparatus of the three-dimensional cam of the fourth embodiment.
Figure 20:
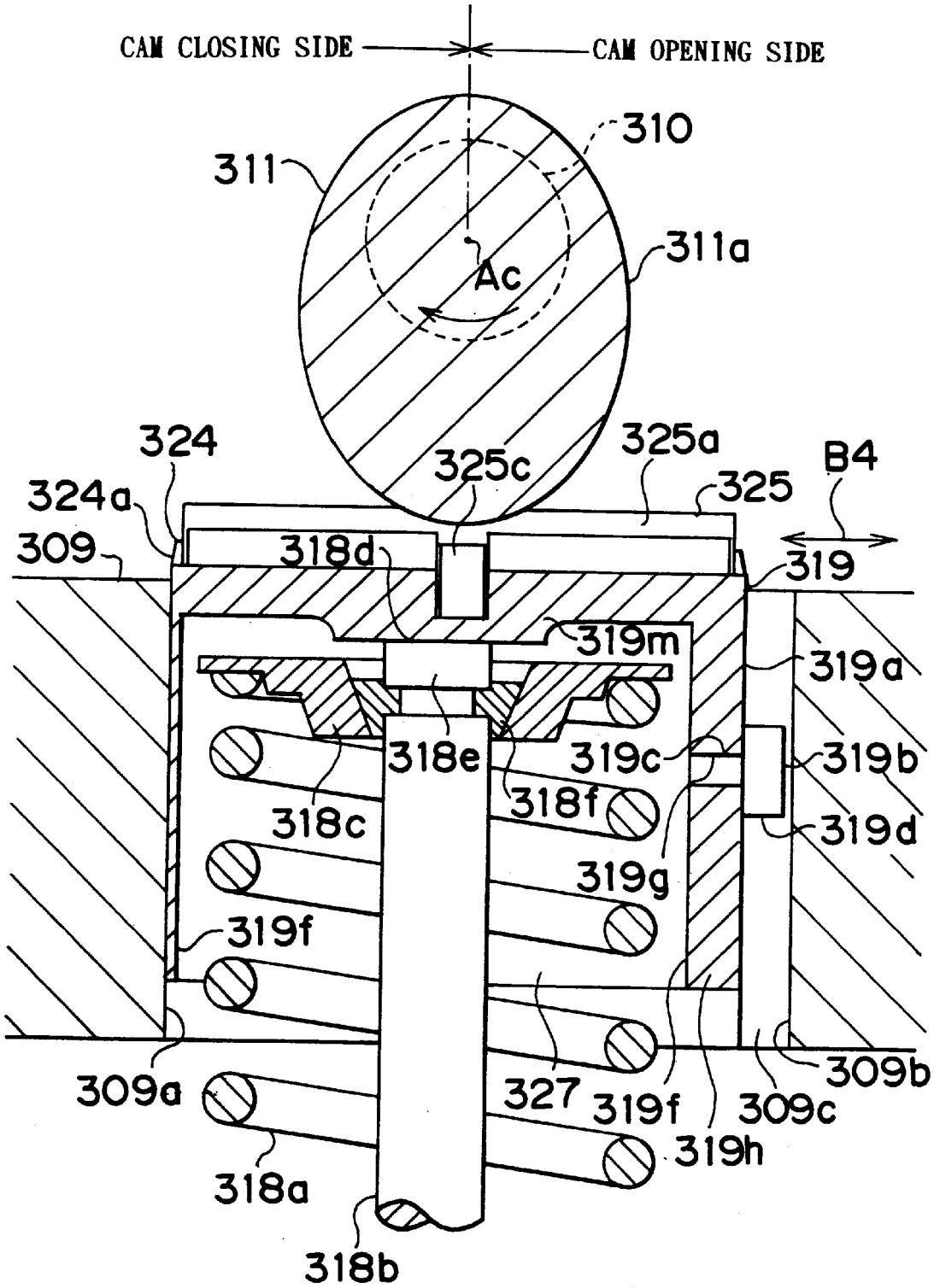
FIG. 20 is a vertical sectional view of the variable valve operating apparatus of the three-dimensional cam of the fourth embodiment.
Figure 21:
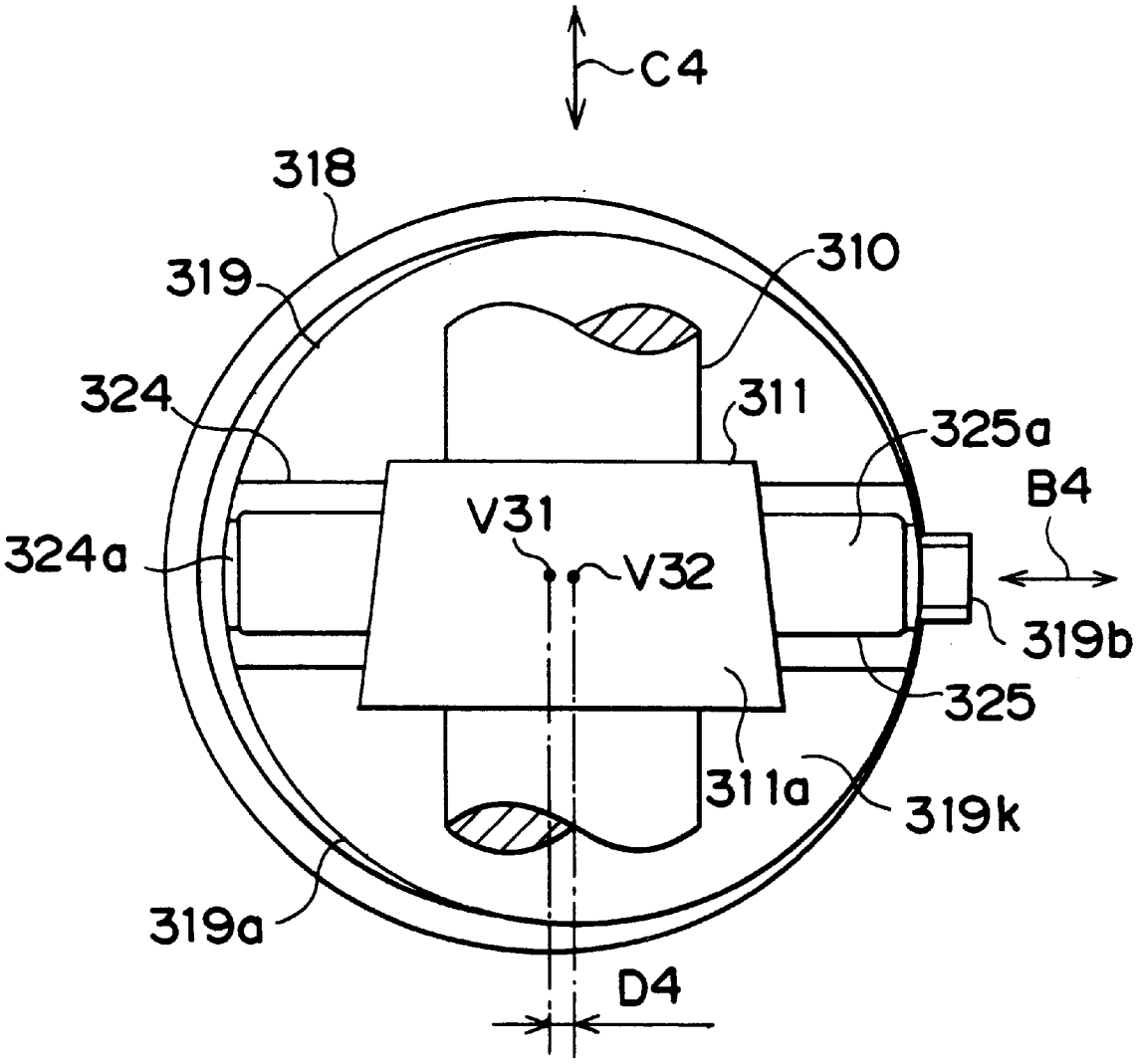
FIG. 21 is a plan view of the variable valve operating apparatus of the three-dimensional cam of the fourth embodiment.

FIGS. 18 and 19 respectively show a perspective view and an exploded perspective view of essential portions of a valve lifter 319 and a variable valve operating apparatus of the fourth embodiment. FIG. 20 is a vertical sectional view of an intake cam 311 in its axial direction (the direction of the arrow C4 in the drawing), and FIG. 21 is a plan view. Elements having the same functions as those of the first embodiment are designated with reference numbers obtained by adding 300 thereto.

As apparent from the drawings, the important difference between the fourth embodiment and the first embodiment is that direction of a rotation axis (a direction of the arrow C4 in the drawings) of the intake cam 311 is perpendicular to a direction of an offset D4.

Therefore, a cam follower holder 324 and a cam follower 325 disposed in correspondence with the intake cam 311 are disposed at positions turned at 90° as compared with the first embodiment. That is, a direction (direction of the arrow B4 in the the drawings) of the rocking axis of the same as that of the offset D4.

However, the cam follower holder 324 and the cam follower 325 are disposed on the center axis V32 (corresponding to the center position of the top surface 319*k*) of an outer peripheral surface 319*a* of the valve lifter 319. Therefore, the length of a cam sliding surface 325*a* of the cam follower 325 is the same as in the case of the first embodiment.

The rotation axis Ac of the intake cam 311 is perpendicular to the center axis V32 and faces the cam sliding surface 32*a* of the cam follower 325. Therefore, the rotation axis Ac of the intake cam 311 exists at a position dividing the cam sliding surface 325*a* in half.

The offset D4 is not always the same as the offsets D1 to D3.

According to the aforementioned fourth embodiment, the rotation axis Ac of the intake cam 311 is disposed at the central portion of the cam sliding surface 325*a*. Therefore, the length of the cam closing side and the length of the cam opening side of the cam sliding surface 325*a* are the same.

Therefore, the lift speeds when the intake valve 318 is opened and closed can be equal to each other, and a sufficient lift amount can be secured as a whole.

A fifth embodiment of the invention will be explained next.

Figure 22:
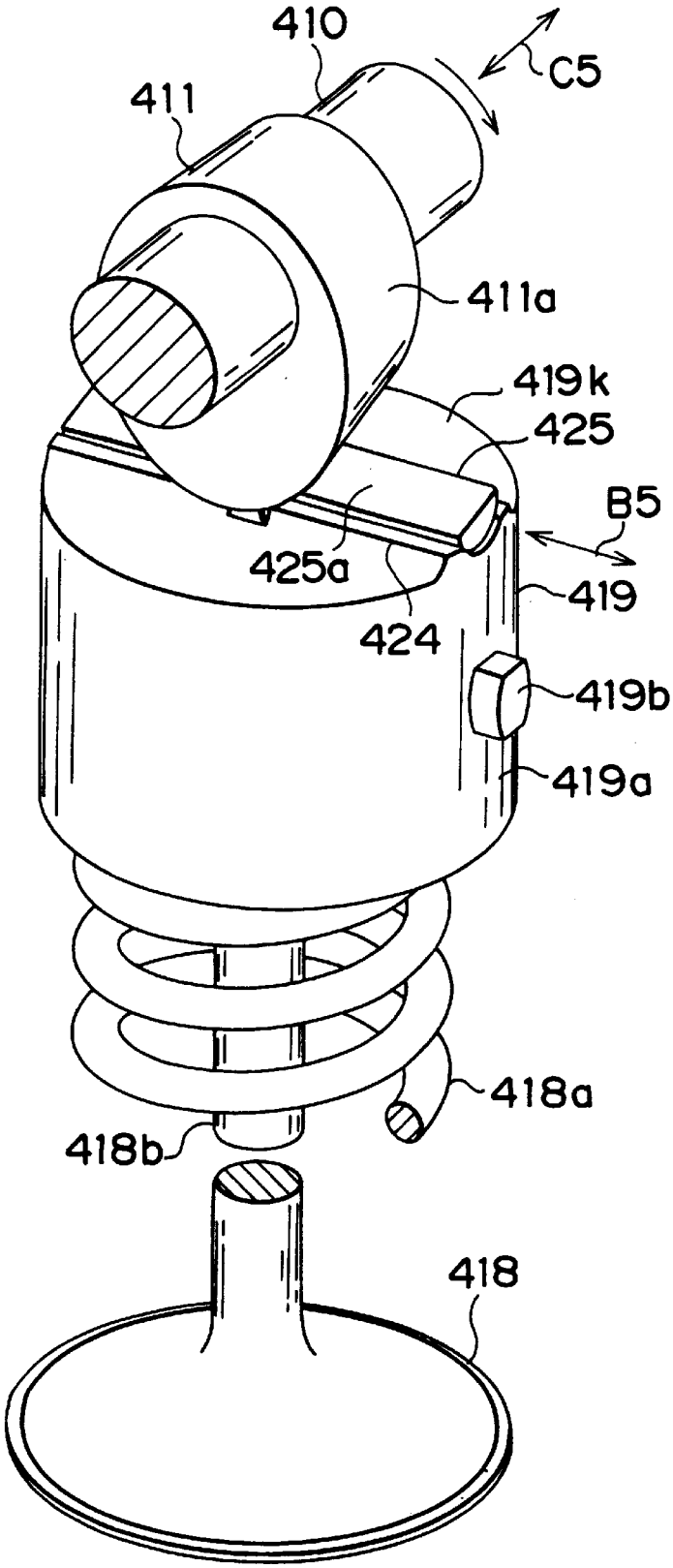
FIG. 22 is a perspective view of a variable valve operating apparatus of a three-dimensional cam of a fifth embodiment.
Figure 23:
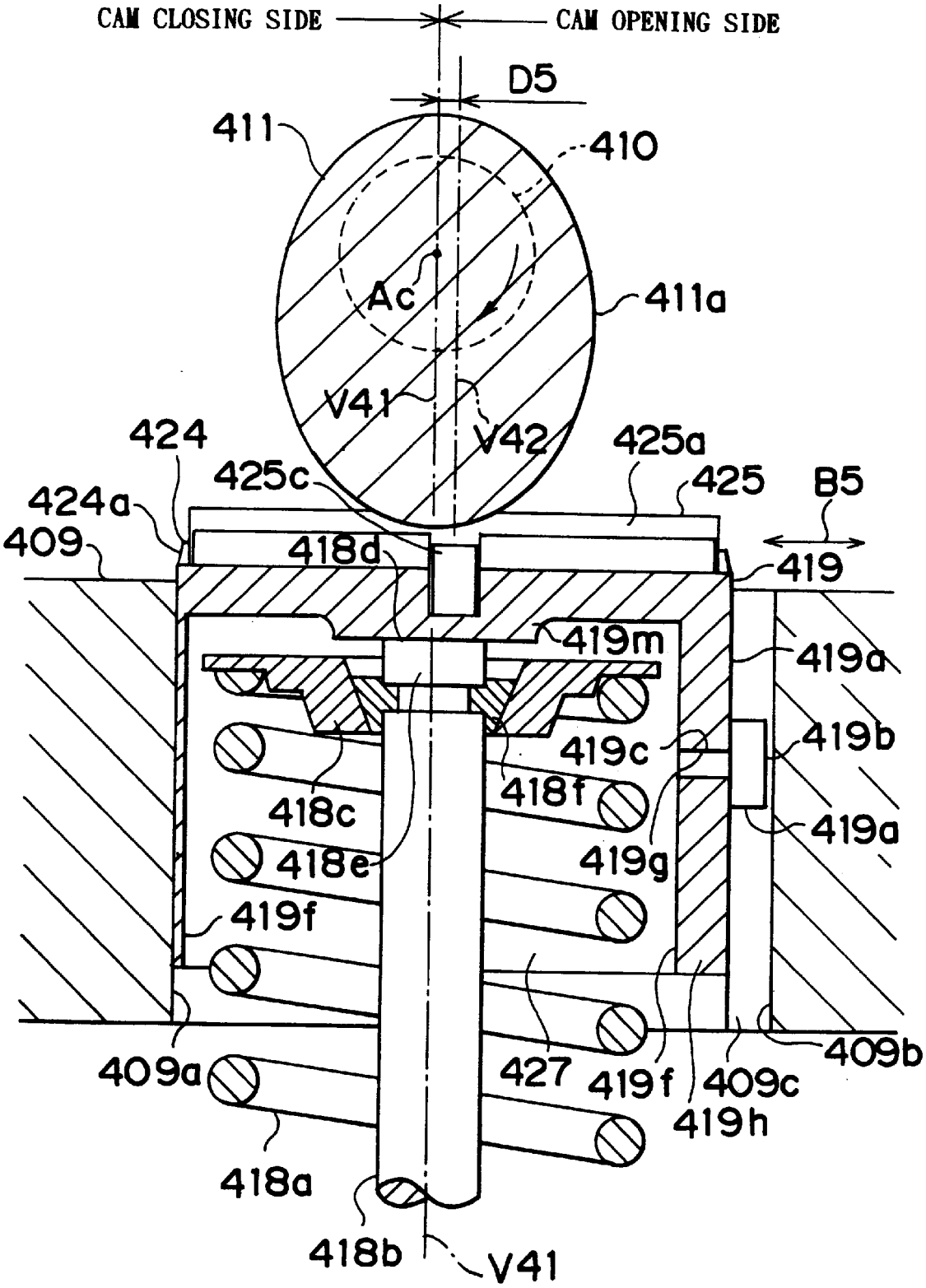
FIG. 23 is a vertical sectional view of the variable valve operating apparatus of the three-dimensional cam of the fifth embodiment.
Figure 24:
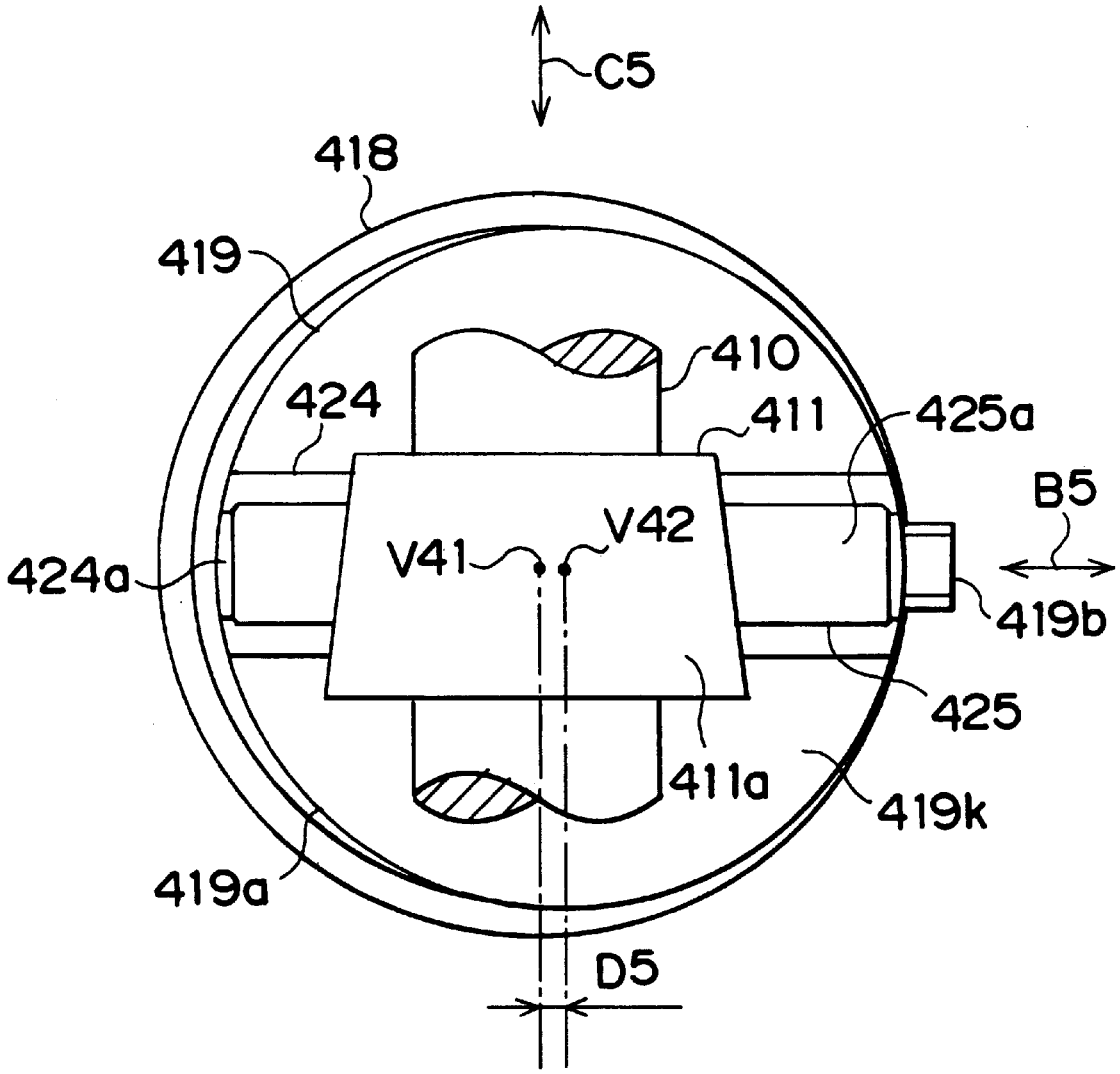
FIG. 24 is a plan view of the variable valve operating apparatus of the three-dimensional cam of the fifth embodiment.

FIG. 22 show a perspective view of essential portions 19 and a variable valve operating apparatus of the fifth embodiment. FIG. 23 is a vertical sectional view of an intake cam 411 in a direction perpendicular to a direction (direction of the arrow CS in the drawing) of a rotation axis of an intake cam 411, and FIG. 24 is a plan view. Elements having the same functions as those of the first embodiment are designated with reference numbers obtained by adding 400 thereto.

As apparent from FIGS. 23 and 24, the difference between the fifth embodiment and the first embodiment is that a rotation axis Ac of the intake cam 411 is not on the center axis V42 of an outer peripheral surface 419*a* of a valve lifter 419, but faces a cam sliding surface 425*a* of a cam follower 425. Therefore, the rotation axis Ac of the intake intake cam 411 is on the center axis (same as the center axis V41 of an inner peripheral surface 419*f*) of a valve stem 418*b*, and perpendicular to the center axis.

On the other hand, the centers of the cam follower holder 424 and the cam follower 425 are disposed on the center axis V42 of the outer peripheral surface 419*a* of the valve lifter 419 as in the fourth embodiment. For this reason, as shown in FIG. 23, a cam sliding surface 425*a* of the cam follower 425 distributed to the cam opening side with respect to the rotation axis Ac of the intake cam 411 as the center is longer than the cam sliding surface 425*a* distributed to the cam closing side.

The offset D5 between the center axis V42 of the outer peripheral surface 419*a* and the center axis V41 of the inner peripheral surface 419*f* is not always the same as offsets D1 to D4.

According to the aforementioned fifth embodiment, the rotation axis Ac of the intake cam 411 is disposed to be shifted toward the cam closing side from the central portion of the cam sliding surface 425*a*. Therefore, since the cam opening side becomes longer, the height of the cam nose of the intake cam 411 at the cam opening side can further be increased. Thus, when the intake valve 418 is opened, the maximum opening speed can be increased.

Figure 25:
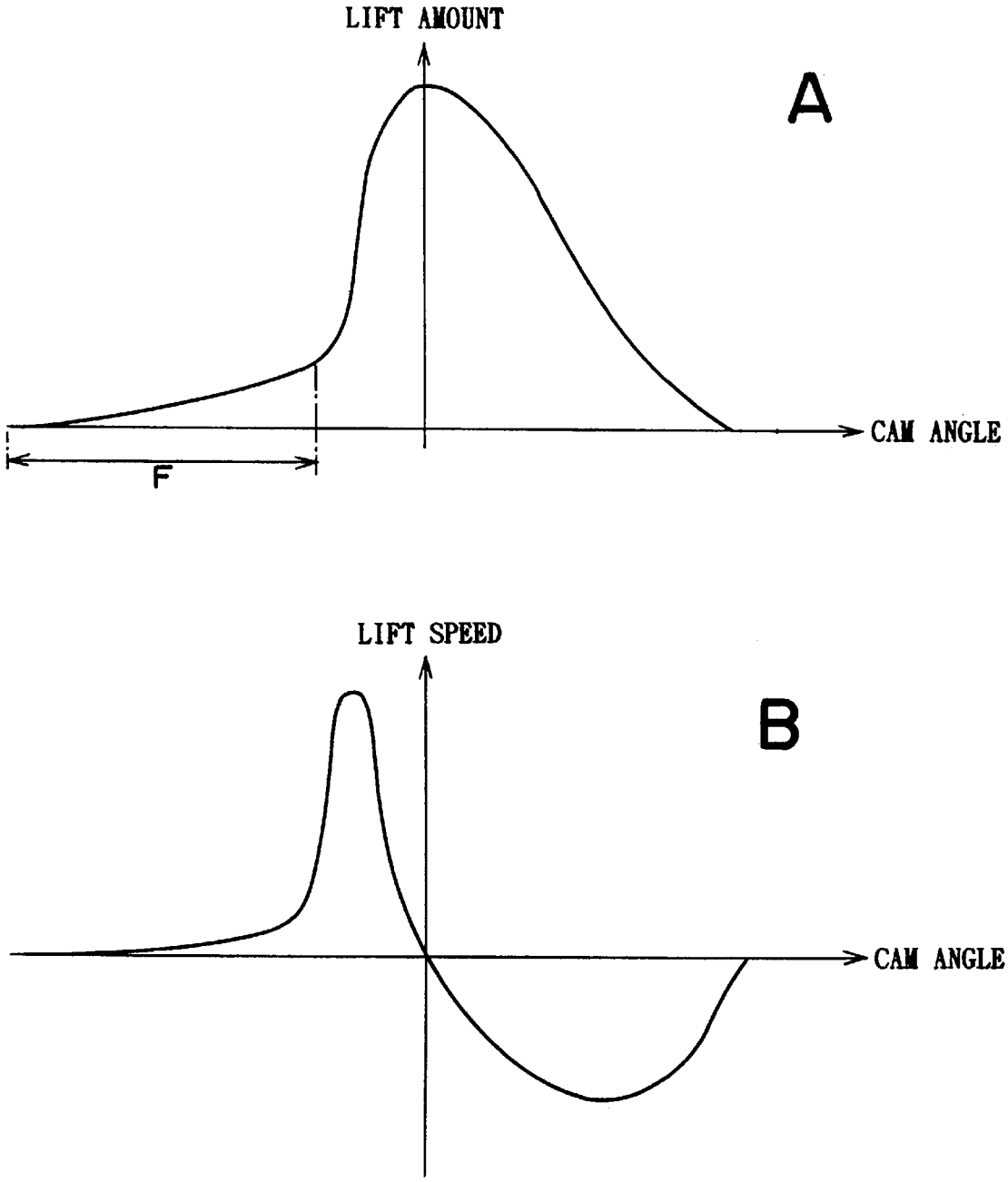
FIGS. 25A–B are graphs showing the relation among a cam angle, a lift amount and a lift speed.

If the opening speed of the intake valve 418 can be increased in this manner, even if a time period F during which the lift amount is slowly increased at the initial time of the opening action of the intake valve 418 is elongated, the intake valve 418 can rapidly be opened to a required lift amount after that (FIG. 25A). By elongating the time period F during which the lift amount is slowly increased at the initial time of the opening action in this manner, it is possible to prevent a piston stamp when a valve-overlapping time period with respect to the exhaust valve is set longer.

Figure 26:
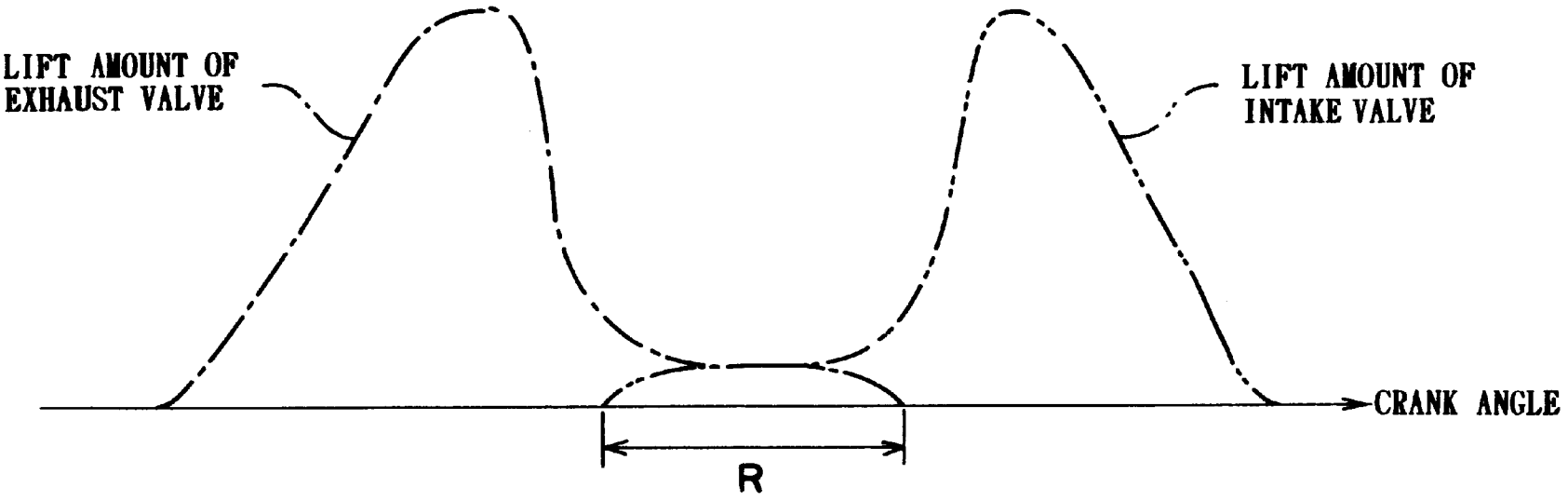
FIG. 26 is a graph showing the relation between a cam angle and a lift amount.

In this case, as an exhaust valve side structure, the cam closing side and the cam opening side in the structure shown in FIGS. 22 to 24 maybe reversed. If a time period during which the lift amount is slowly reduced at the end of the opening action of the exhaust valve is set longer, there is no fear that the piston stamp is generated in both the intake valve 418 and the exhaust valve, and a sufficiently long valve-overlapping VO can be achieved (FIG. 26).

Figure 27:
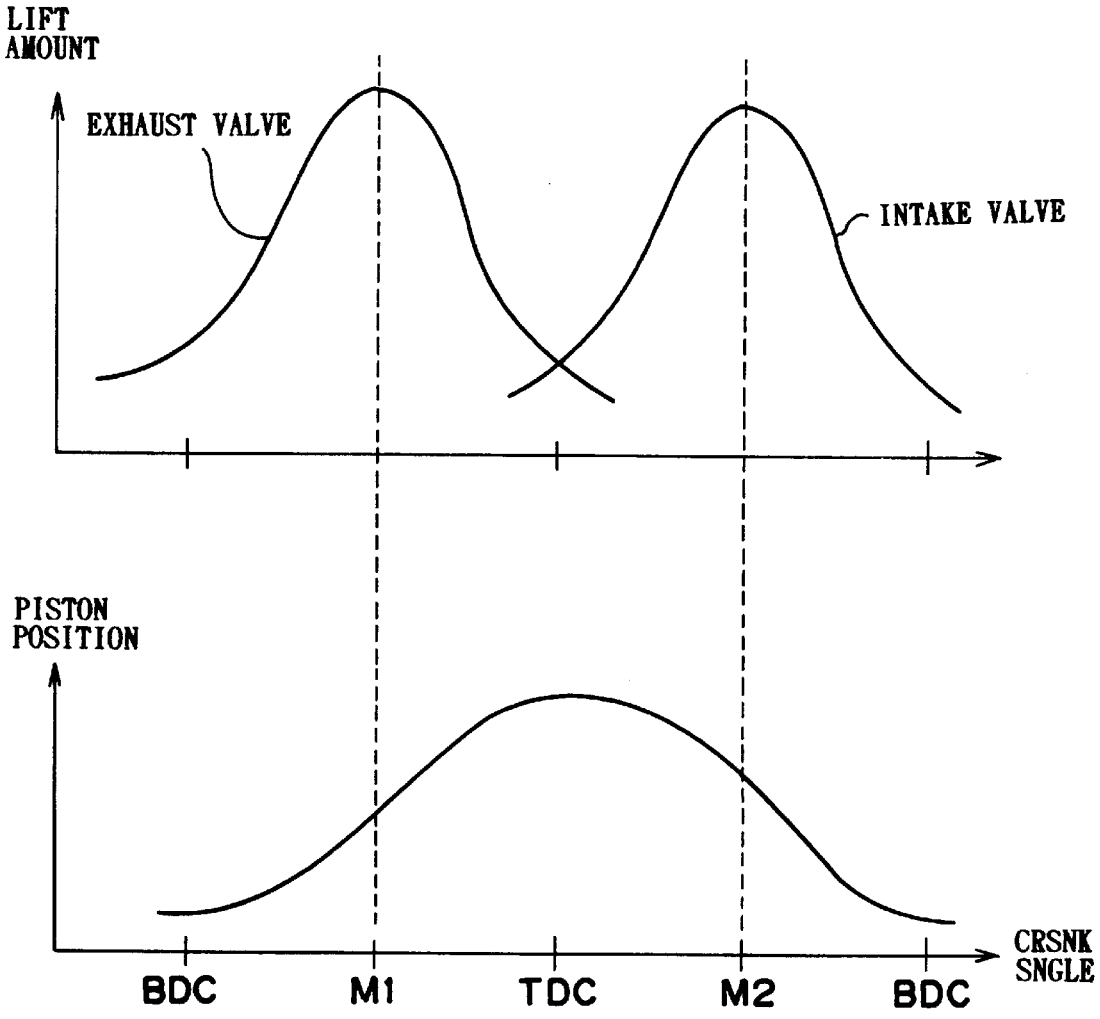
FIG. 27 is a graph showing the relation among a cam angle, a lift amount and a position of a piston.

Further, utilizing this structure, the lift amount of the exhaust valve may be set to maximum at a timing M1 when the piston rising speed reaches the maximum, thereby enhancing the exhausting efficiency as shown in FIG. 27. Alternatively, the lift amount of the intake valve 418 may be set to maximum at a timing M2 when the piston lowering speed reaches the maximum, thereby enhancing the intake efficiency.

As described above, according to the fifth embodiment, the valve lifting speed at the initial stage and the end stage can be easily controlled, and the flexibility of the control of the valve lift amount is enhanced.

Although the rotation axis of the intake cam is perpendicular to the center axis of the valve stem at the position of the center axis of the valve stem in the fifth embodiment, the rotation axis of the intake cam may be disposed to face any of the regions from the center axis of the outer peripheral surface of the valve lifter and the center axis of the valve stem.

A sixth embodiment of the invention will be described.

Figure 28:
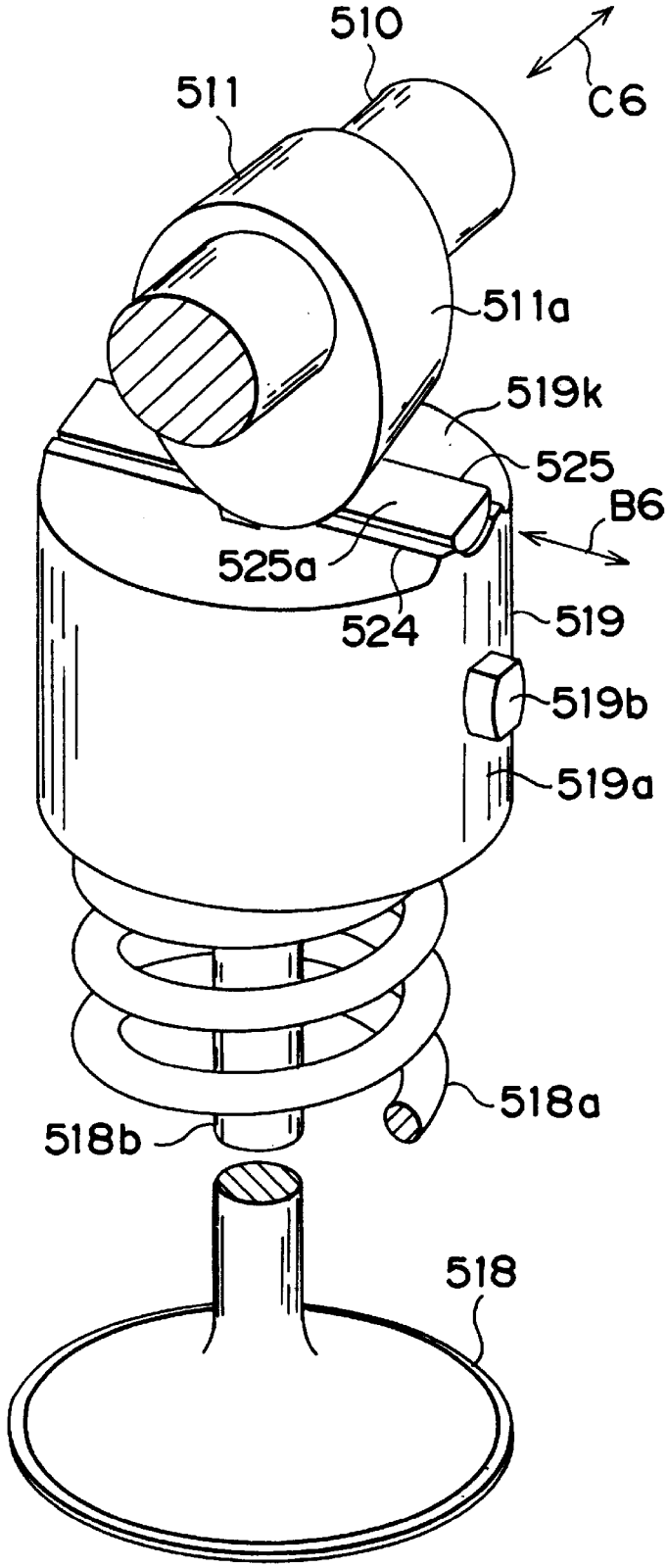
FIG. 28 is a perspective view of a variable valve operating apparatus of a three-dimensional cam of a sixth embodiment.
Figure 29:
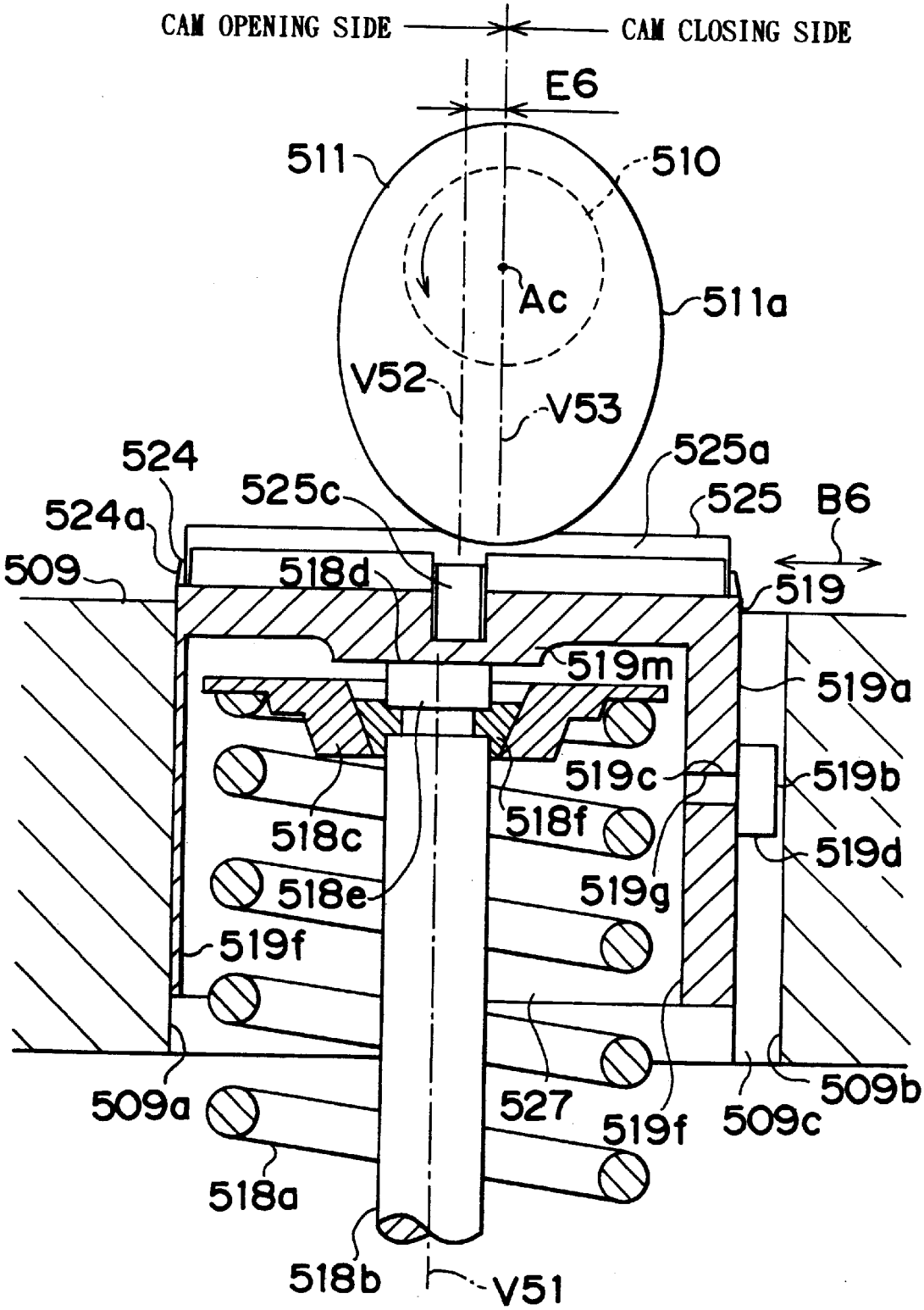
FIG. 29 is a vertical sectional view of the variable valve operating apparatus of the three-dimensional cam of the sixth embodiment.
Figure 30:
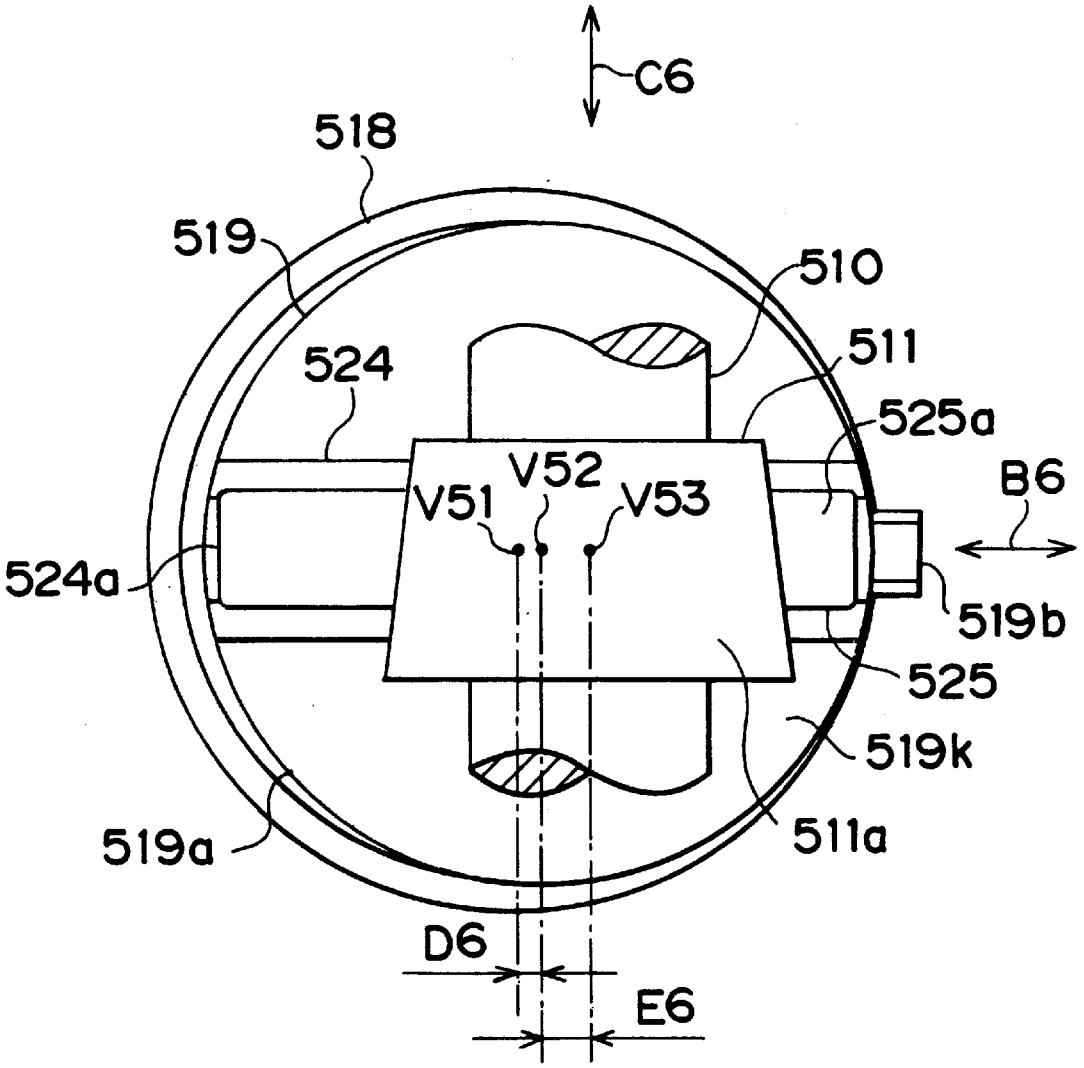
FIG. 30 is a plan view of the variable valve operating apparatus of the three-dimensional cam of the sixth embodiment.

FIG. 28 shows a perspective view of essential portions of a valve lifter 519 and a variable valve operating apparatus of the sixth embodiment. FIG. 29 is a vertical sectional view of an intake cam 511 in a direction perpendicular to a direction (direction of the arrow C6 in the drawing) of a rotation axis of an intake cam 511, and FIG. 30 is a plan view. Elements having the same functions as those of the first embodiment are designated with reference numbers obtained by adding 500 thereto.

As apparent from FIGS. 29 and 30, the difference between the sixth embodiment and the fourth embodiment is that a rotation axis Ac of the intake cam 511 is offset by E6 toward a position V53 opposite from the center axis V51 of an inner peripheral surface 519*f* with respect to the center axis V52 of an outer peripheral surface 519*a* of a valve lifter 519. The offset E6 is not always the same as the-offset E3 of the third embodiment. Therefore, the rotation axis Ac of the intake cam 511 is perpendicular to a direction of the center axis (same as the center axis V51 of the inner peripheral surface 519*f*) of a valve stem 518*b* at a position greatly separated from the center axis of the valve stem 518*b*.

On the other hand, centers of the cam follower holder 524 and the cam follower 525 are disposed on the center position (position on the center axis V52 of the outer peripheral surface 519*a*) of the top surface 519*k* of the valve lifter 519 as in the fourth and fifth embodiments. The rotation direction of the intake cam 511 is opposite from those of the fourth and fifth embodiments. For this reason, as shown in FIG. 29, a cam sliding surface 525*a* of the cam follower 525 distributed to the cam opening side with respect to the rotation axis Ac of the intake cam 511 as the center is longer than the cam sliding surface 525*a* distributed to the cam closing side.

The offset D6 between the center axis V52 of the outer peripheral surface 519*a* and the center axis V51 of the inner peripheral surface 519*f* is not always the same as offsets D1 to D5.

Figure 31:
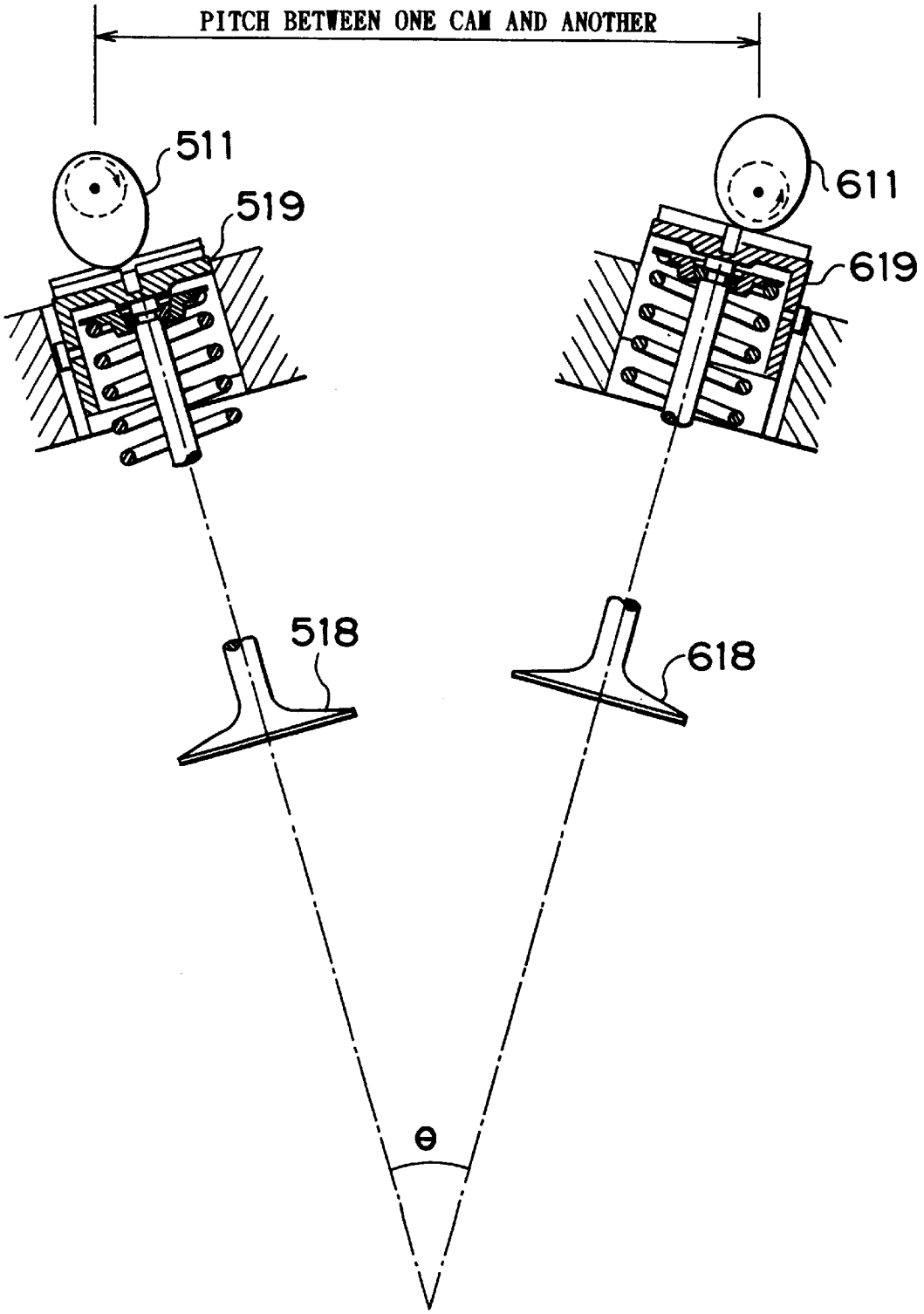
FIG. 31 is a view for explaining one example of disposition of the cam of the sixth embodiment.

According to the aforementioned sixth embodiment, since the center axis (V51) of the intake valve 518 and the rotation axis Ac (V53) of the intake valve cam 511 are greatly separated from each other, even if the distance of the intake valve 518 and the exhaust valve is short, the intake cam 511 and the exhaust cam can be disposed away from each other. For example, when the structure of the sixth embodiment is applied to both the valve lifter 519 of the intake cam 511 and the valve lifter 619 of the exhaust cam 611 as shown in FIG. 31, even if the distance between the intake valve 518 and the exhaust valve 618 is short, it is possible to further increase the pitch between the intake cam 511 and the exhaust cam 611. Reversely, even if the distance between the intake valve 518 and the exhaust valve 618 is long, it is possible to further reduce the pitch between cams.

Since the flexibility of the mutual disposition of the cam and the valve is enhanced in this manner, the valve sandwiching angle θ can be set while considering the performance of the internal combustion engine without being restricted by the disposition of the cam, which contributes to enhancement of the performance of the internal combustion engine.

Although the detent projection is provided at the side of the valve lifter and the detent groove is provided at the side of the cylinder head in the respective embodiments, the detent groove may be provided at the side of the valve lifter and the detent projection may be provided at the side of the cylinder head.

Although each of the side surfaces of the projecting portion facing the side surface of the detent groove has the arcuate shape in each of the embodiments, the upper and lower opposite ends of the side surfaces of the projecting portion may have shapes chamfered gently instead of being arcuate. In this case, it is also possible to prevent the angled portion of the upper and lower ends from contacting with the opposed side surfaces of the groove when the valve lifter is cocked.

The offset between the outer peripheral surface and the inner peripheral surface shown in each of the embodiment is just an example, and the offset amount may be increased or decreased as required.

Figure 32:
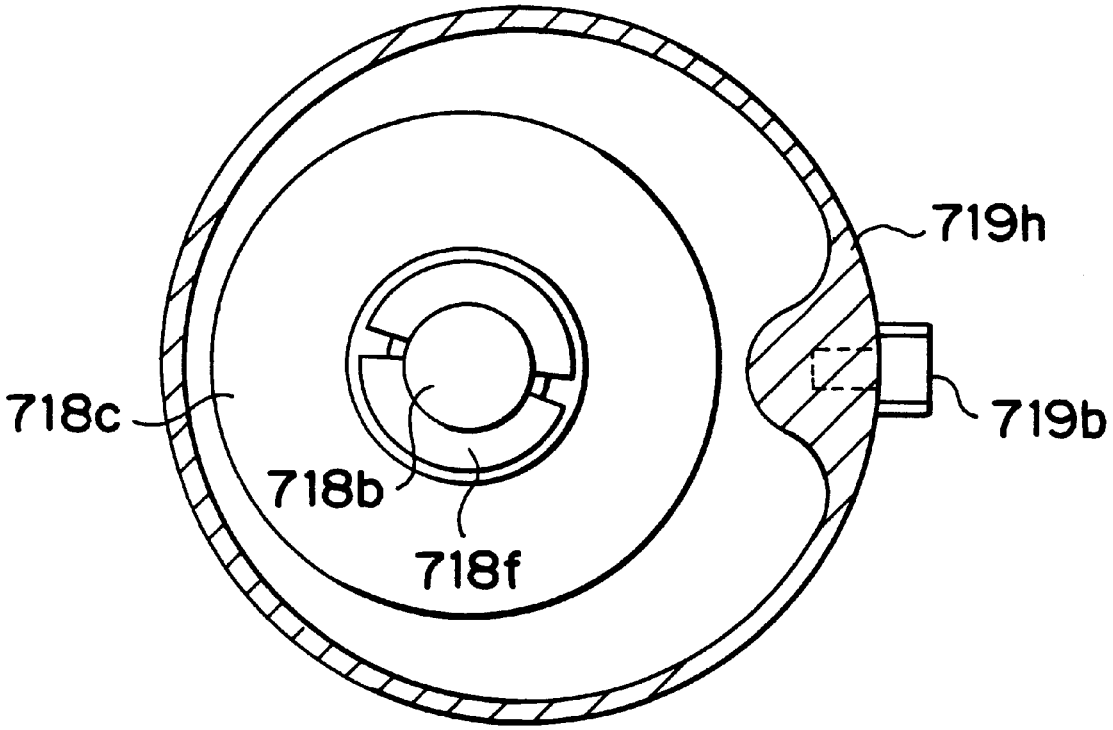
FIGS. 32 to 34 are transverse sectional views for showing the structure of the variable valve operating apparatus of the three-dimensional cam.

The outer peripheral surface and the inner peripheral surface are cylindrical in shape and the center axes thereof are offset in each of the embodiment. Alternatively, only a portion of the valve lifter where the detent projection is provided (the same is true when the groove is provided) may be remained thick, and other portion may be thinned, thereby reducing the weight. For example, as shown in FIG. 32, the circle accommodation space in which a valve stem 718*b*, a retainer 718*c*, a valve cotter 718*f*, a spring and the like are accommodated may be secured, and the thickness of the detent projection 719*b* may be maintained, and a peripheral wall 719 of the valve lifter may be thinned to the utmost.

Figure 33:
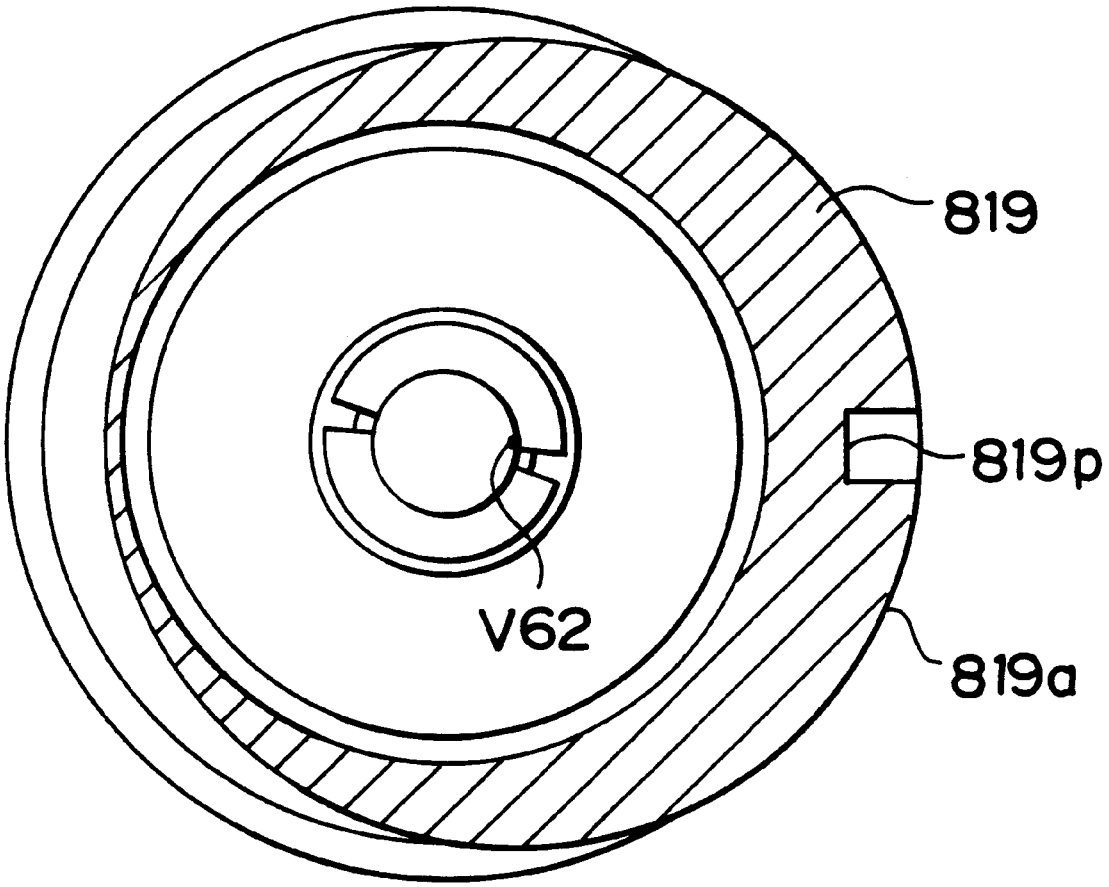
Figure 34:
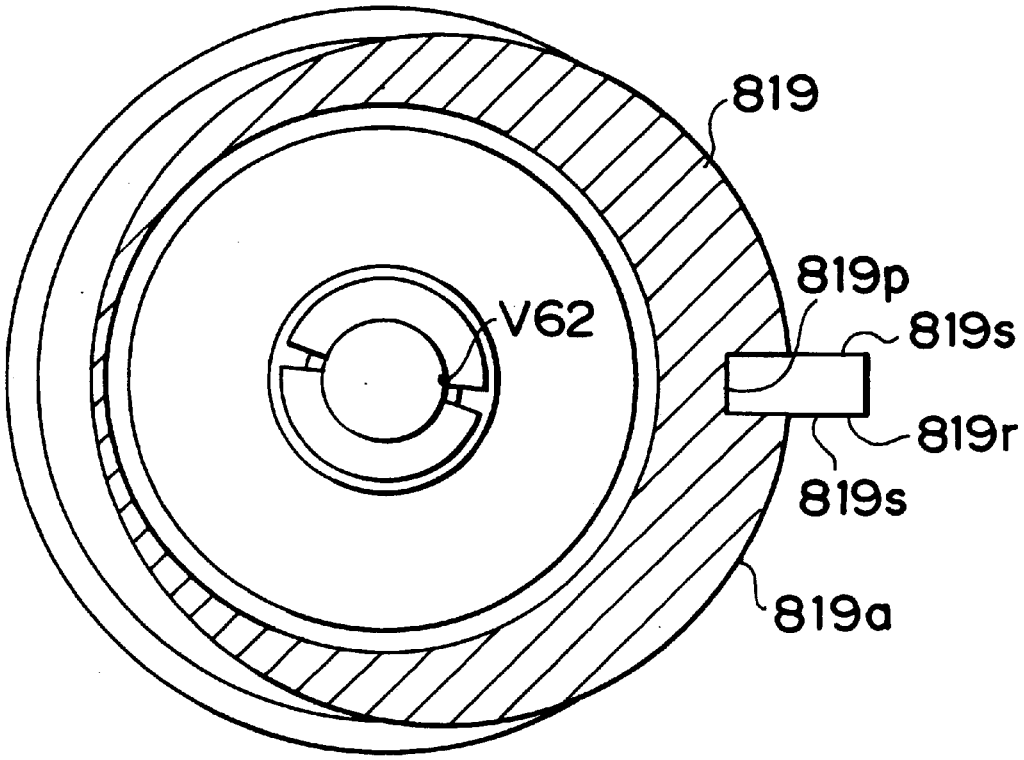
Figure 35:
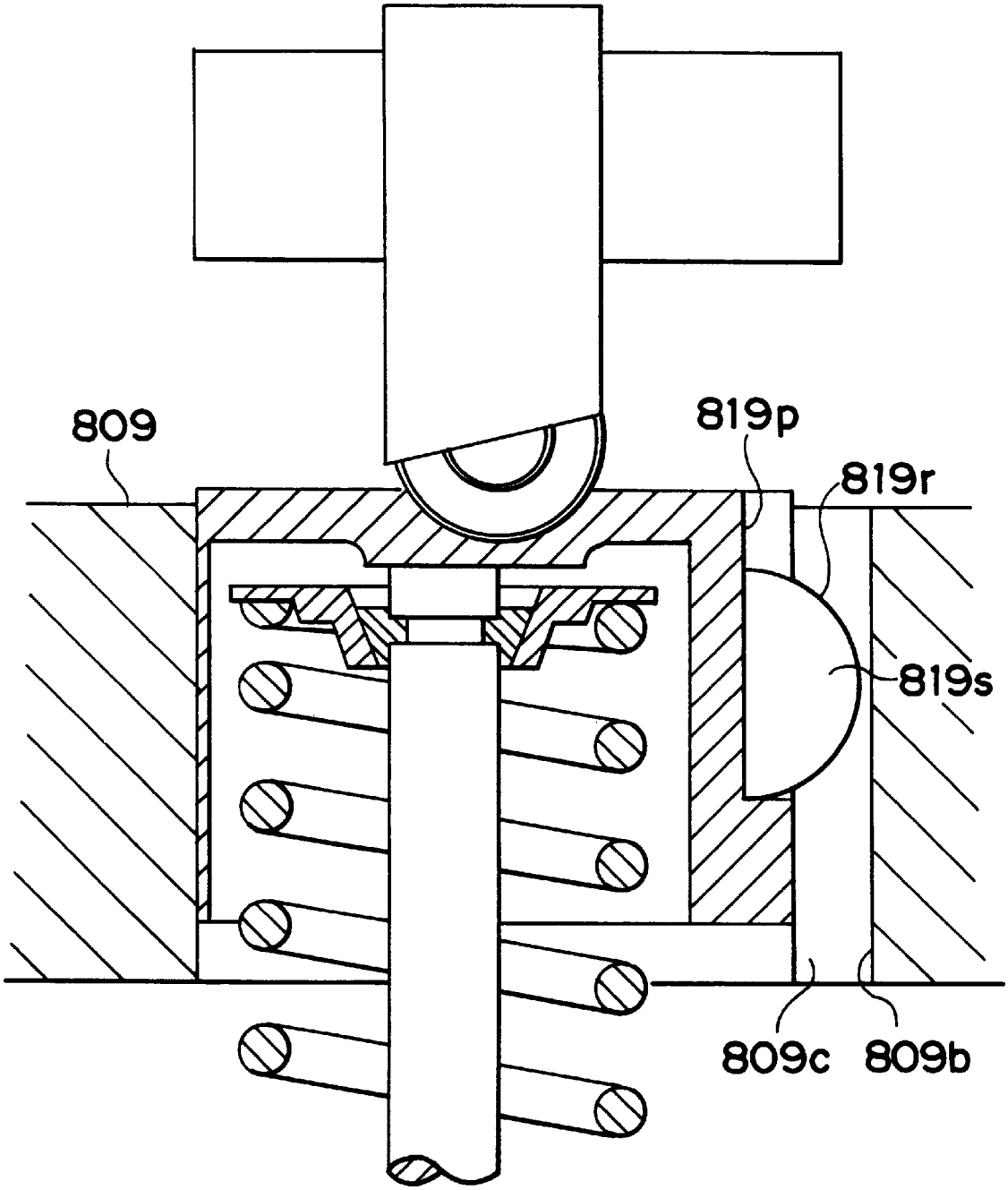
FIGS. 35 and 36 are vertical sectional views for showing the structure of the variable valve operating apparatus of the three-dimensional cam.

As shown in FIGS. 33 to 35, in order to provide a detent projection on an outer peripheral surface 819*a* of a valve lifter 819, a groove 819*p* may be formed into a vertical groove along the center axis V62 of the outer peripheral surface 819*a*, and a short semicolumnar key 819*r* may be fitted and fixed into the vertical groove. Since side surfaces 819*s* of the key 819*r* have wide areas, it is possible to reduce the surface pressure with respect to side surfaces 809*c* of a detent groove 809*b* provided in a cylinder head 809, to effectively prevent abnormal abrasion, and to enhance the durability of the detent mechanism.

Figure 36:
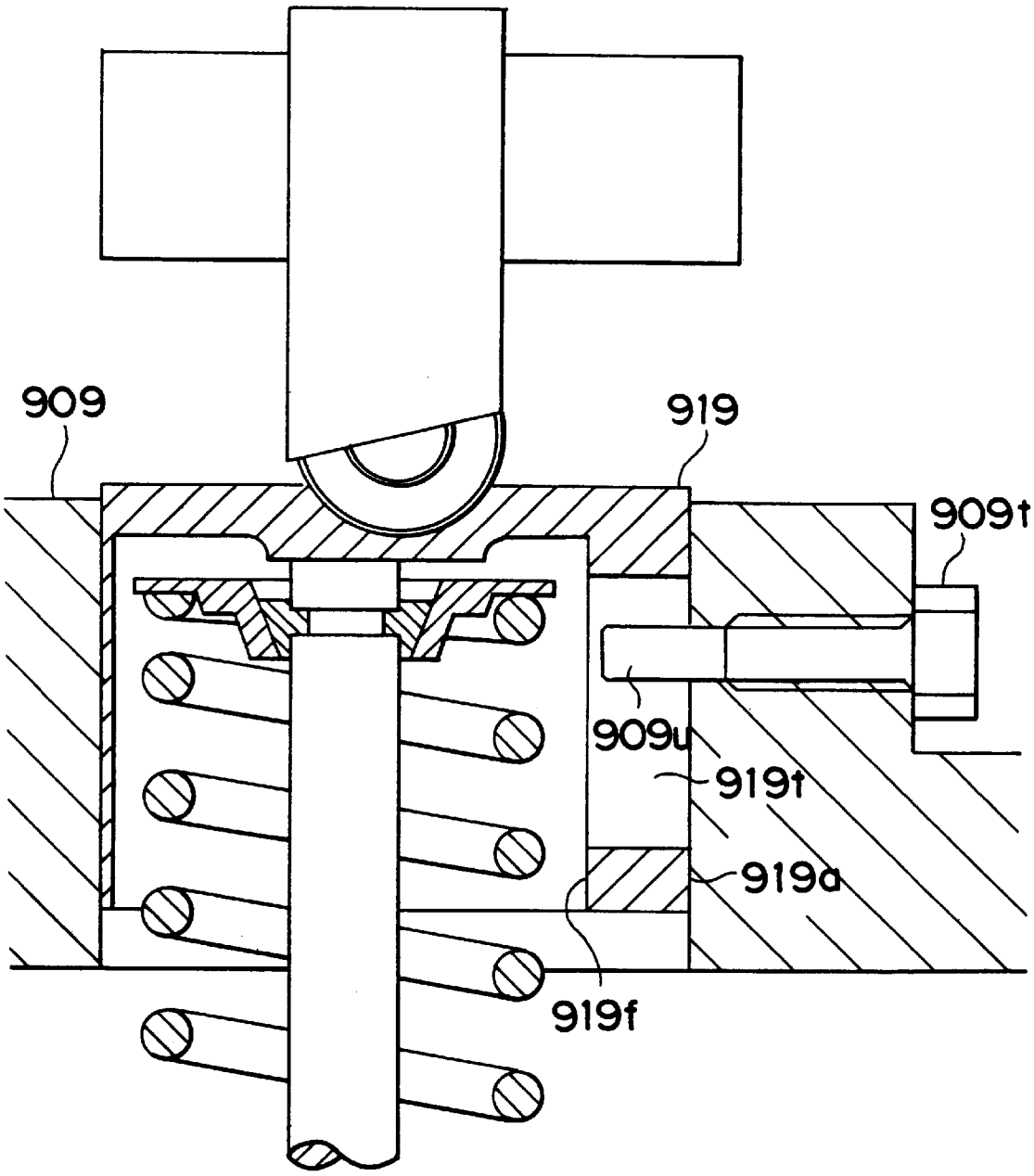

As shown in FIG. 36, instead of providing the detent projection, a detent elongated hole 919*t* passing through an inner peripheral surface 919*f* from an outer peripheral surface 919*a* of a valve lifter 919 may be provided along the center axis of the outer peripheral surface. By projecting a tip end 909*u* of a bolt 909*t* or the like into the elongated hole 919*t* from the side of a cylinder head 909, a detent mechanism can be formed. The hole may not be a through hole like the detent elongated hole 919*t*, and it may be a detent groove provided in the direction of the center axis of the outer peripheral surface of the valve lifter 919.

Although the intake cam is formed as the three-dimensional cam and the valve lifter is provided with the cam follower in each of the embodiments, the exhaust cam may be formed as the three-dimensional cam and may be incorporated in the structure described in each of the embodiments. In this case, a shaft driving mechanism which is the same as that provided in the intake cam shaft is provided also in the exhaust cam shaft, and the exhaust cam shaft is movable in its axial direction.

In the structure of the projection in each of the embodiments, the radius of curvature R may be formed to be larger than a half of the width W1 of upper and lower surfaces of the projecting portion 19*d* as shown in FIG. 6.

Figure 37:
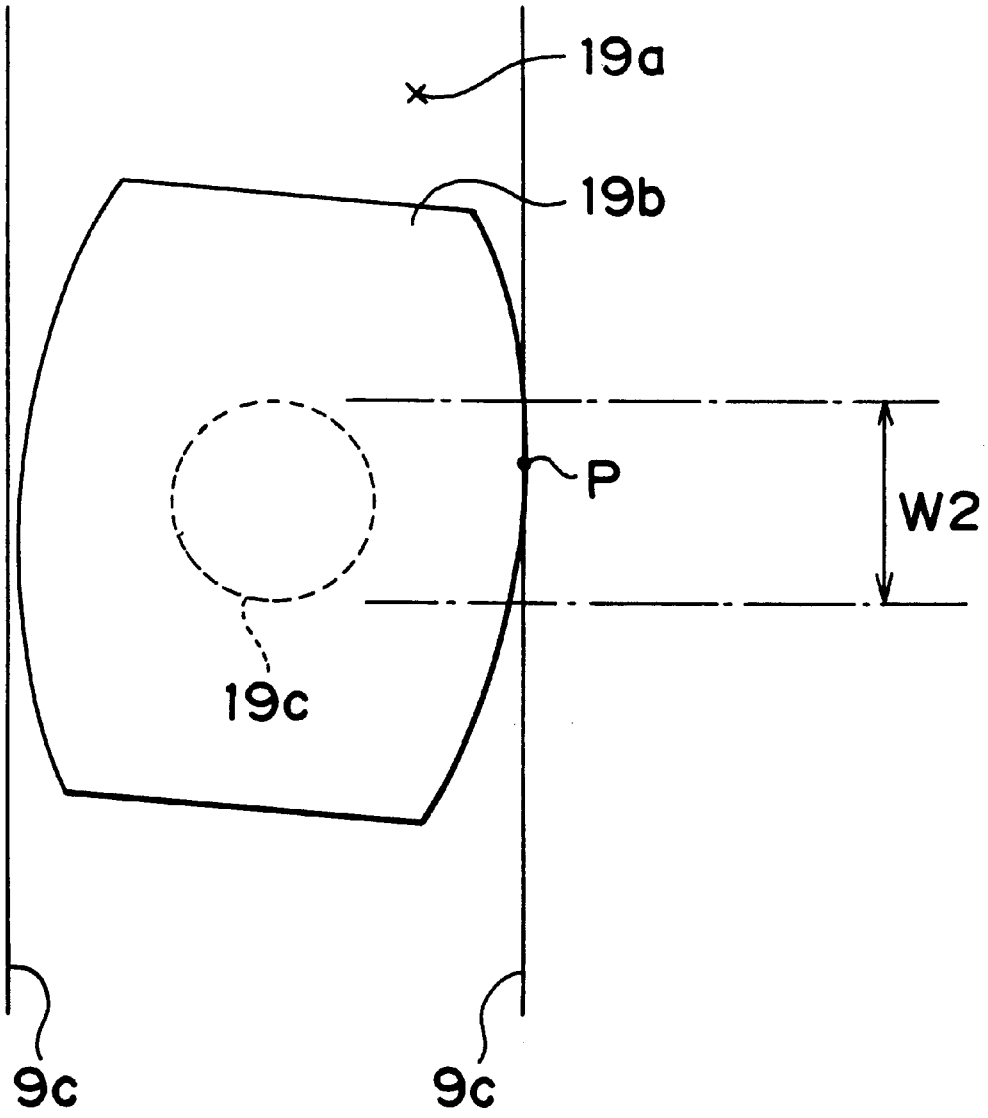
FIG. 37 is a view for explaining a structure of a projection.
Figure 38:
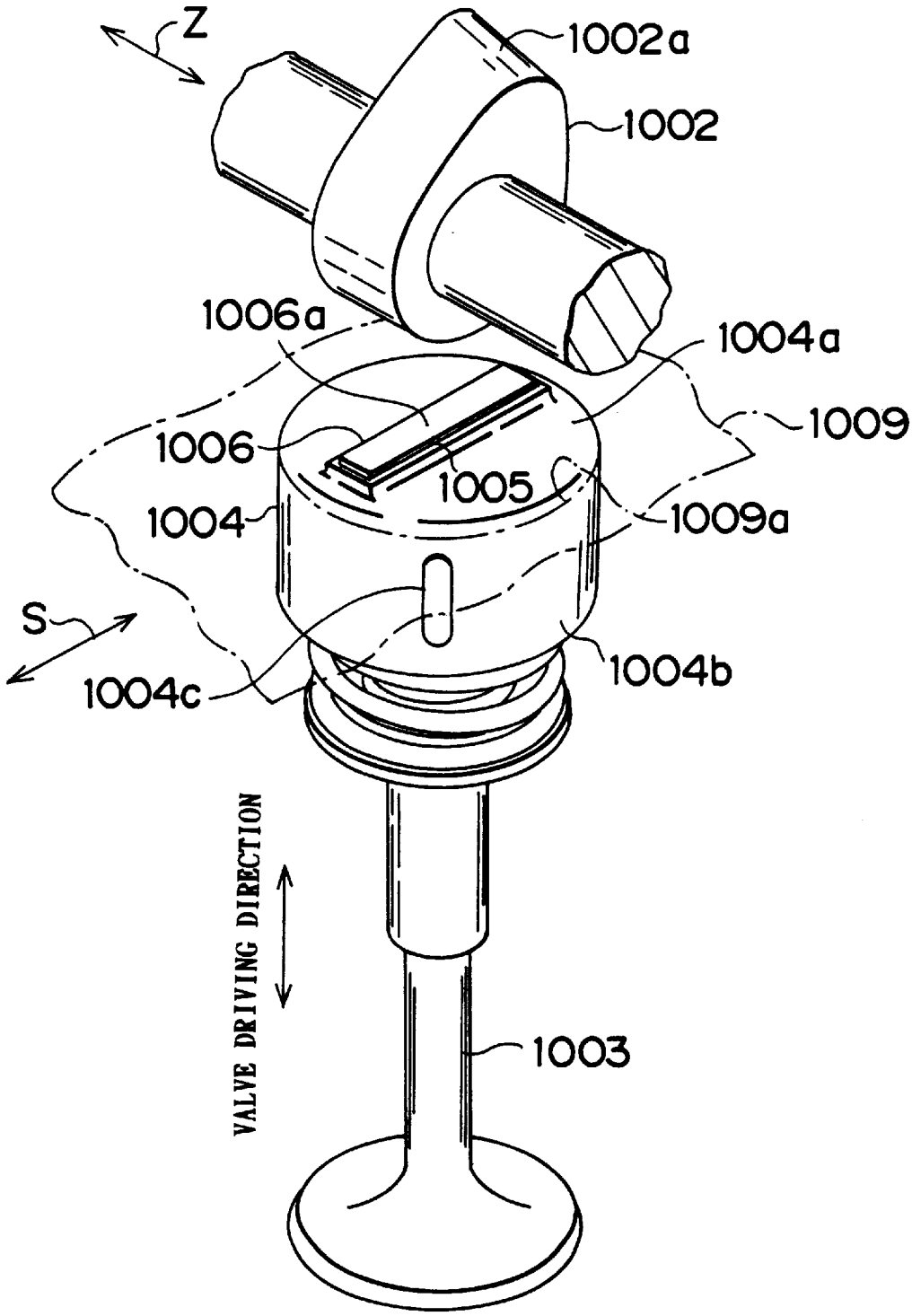
FIG. 38 RELATED ART
FIG. 38 is a view for explaining a structure of a variable valve operating apparatus of a three-dimensional cam of the related art.

A position P where the projecting portion 19*d* contacts with the side surface of the detent groove may be set within the vertical width W2 of the force fit portion 19*c* when R is set larger than ½ and the valve lifter is inclined with respect to the center axis of the lifter bore as shown in FIG. 37, i.e., when the lifter is cocked. With this structure, the moment applied to the force fit portion 19*c* from the side surface 9*c* at the contact position P is reduced, and the force fit portion 19*c* receives most of the force from the contact position P and therefore, the durability of the mounted projection 19*b* is enhanced.

Although the projection is mounted by the force fit in each of the embodiments, the projection may be mounted to the outer peripheral surface of the valve lifter using another method, such as welding. In this case also, since the projection is mounted on the thick portion which is formed longer in the direction of the center axis of the valve lifter, the valve lifter is not deformed, and the projection can be mounted allowing high flexibility in design.

What is claimed is:

1. A valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and a substantially cylindrical accommodation chamber defined by an inner peripheral surface of the valve lifter in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum, the thick wall portion of the valve lifter being formed by offsetting the inner peripheral surface from the cylindrical outer peripheral surface.

2. A valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter, the projection having an arcuate, convex surface facing a side surface of the groove to be engaged; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum.

3. A valve lifter for a three-dimensional cam according to claim 2, wherein a radius of curvature of the arcuate, convex surface is greater than a half of the width of a projection in a direction perpendicular to the side surface of the groove.

4. A valve lifter for a three-dimensional cam according to claim 3, wherein a position contacting the side surface of the groove is within a mounting width of the projection with respect to the outer peripheral surface in a direction of the side surface of the groove, when the center axis of the valve lifter for the three-dimensional cam is inclined with respect to a center axis of the lifter bore.

5. A valve lifter for a three-dimensional cam accommodated in a lifter bore provided in a cylinder head of an internal combustion engine, comprising:

a cylindrical outer peripheral surface having a projection engageable with a groove in the lifter bore formed at least partially for prevention rotation of the valve lifter opposite ends of a surface of the projection facing a side surface of the groove to be engaged having a shape that is chamfered gently; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum.

6. A valve lifter operating apparatus for a three-dimensional cam including the valve lifter of claim 1 and a lifter bore with a groove, wherein the groove in the lifter bore is an elongated bore.

7. A variable valve operating apparatus comprising:

a valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum;

a three-dimensional cam rotating in accordance with rotation of an internal combustion engine, a profile of the three-dimensional cam being varied in a direction of its rotation axis; and a rocking follower swingably supported on the valve lifter for the three-dimensional cam, the rocking follower transmitting a lift amount of the three-dimensional cam to the valve lifter that varies in accordance with the rotation of the internal combustion engine by contacting a cam surface of the three-dimensional cam, wherein an offset of the valve lifter for the three-dimensional cam is provided in the direction of the rotation axis of the three-dimensional cam, and the three-dimensional cam and the rocking follower are offset from the center axis of the outer peripheral surface of the valve lifter for the three-dimensional cam on a side of a center axis of the stem end portion of the valve.

8. A variable valve operating apparatus according to claim 7, wherein the three-dimensional cam and the rocking follower are disposed at positions substantially coinciding with the center axis of the stem end portion of the valve.

9. A variable valve operating apparatus comprising:

a valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum;

a three-dimensional cam rotating in accordance with rotation of an internal combustion engine, a profile of the three-dimensional cam being varied in a direction of its rotation axis; and a rocking follower swingably supported on the valve lifter for the three-dimensional cam, the rocking follower transmitting a lift amount of the three-dimensional cam to the valve lifter that varies in accordance with the rotation of the internal combustion engine by contacting a cam surface of the three-dimensional cam, wherein an offset of the valve lifter for the three-dimensional cam is provided in the direction of the rotation axis of the three-dimensional cam, and the three-dimensional cam and the rocking follower are disposed at a position substantially coinciding with the center axis of the outer peripheral surface of the valve lifter for the three-dimensional cam.

10. A variable valve operating apparatus comprising:

a valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum;

a three-dimensional cam rotating in accordance with rotation of an internal combustion engine, a profile of the three-dimensional cam being varied in a direction of its rotation axis; and a rocking follower swingably supported on the valve lifter for the three-dimensional cam, the rocking follower transmitting a lift amount of the three-dimensional cam to the valve lifter that varies in accordance with the rotation of the internal combustion engine by contacting a cam surface of the three-dimensional cam, wherein an offset of the valve lifter for the three-dimensional cam is provided in the direction of the rotation axis of the three-dimensional cam, and the three-dimensional cam and the rocking follower are offset from the center axis of the outer peripheral surface of the valve lifter for the three-dimensional cam on a side opposite a center axis of the stem end portion of the valve.

11. A variable valve operating apparatus comprising:

a valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum;

a three-dimensional cam rotating in accordance with rotation of an internal combustion engine, a profile of the three-dimensional cam being varied in a direction of its rotation axis; and a rocking follower swingably supported on the valve lifter for the three-dimensional cam, the rocking follower transmitting a lift amount of the three-dimensional cam to the valve lifter that varies in accordance with the rotation of the internal combustion engine by contacting a cam surface of the three-dimensional cam, wherein an offset of the valve lifter for the three-dimensional cam is provided in a direction perpendicular to the rotation axis of the three-dimensional cam, and the three-dimensional cam and the rocking follower are offset from the center axis of the outer peripheral surface of the valve lifter for the three-dimensional cam on a side of a center axis of the stem end portion of the valve.

12. A variable valve operating apparatus according to claim 11, wherein the three-dimensional cam is disposed at a position where a rotation axis thereof substantially passes the center axis of the stem end portion of the valve.

13. A variable valve operating apparatus comprising:

a valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum;

a three-dimensional cam rotating in accordance with rotation of an internal combustion engine, a profile of the three-dimensional cam being varied in a direction of its rotation axis; and a rocking follower swingably supported on the valve lifter for the three-dimensional cam, the rocking follower transmitting a lift amount of the three-dimensional cam to the valve lifter that varies in accordance with the rotation of the internal combustion engine by contacting a cam surface of the three-dimensional cam, wherein an offset of the valve lifter for the three-dimensional cam is provided in a direction perpendicular to the rotation axis of the three-dimensional cam, and the three-dimensional cam is disposed at a position where the rotation axis thereof substantially passes a center axis of the stem end portion of the valve.

14. A variable valve operating apparatus comprising:

a valve lifter for a three-dimensional cam accommodated in a lifter bore provided in a cylinder head of an internal combustion engine, comprising:

a cylindrical outer peripheral surface having a projection engageable with a groove in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the projection being formed on the outer peripheral surface at a position corresponding to a thick wall portion at which a distance between the outer peripheral surface and the accommodation chamber generated by the offset becomes substantially maximum;

a three-dimensional cam rotating in accordance with rotation of an internal combustion engine, a profile of the three-dimensional cam being varied in a direction of its rotation axis; and a rocking follower swingably supported on the valve lifter for the three-dimensional cam, the rocking follower transmitting a lift amount of the three-dimensional cam to the valve lifter that varies in accordance with the rotation of the internal combustion engine by contacting a cam surface of the three-dimensional cam, wherein an offset of the valve lifter for the three dimensional cam is provided in a direction perpendicular to the rotation axis of the three-dimensional cam, and a rotation axis of the three-dimensional cam is offset from the center axis of the outer peripheral surface of the valve lifter at a side opposite a center axis of the stem end portion of the valve.

15. A valve lifter for a three-dimensional cam accommodated in a lifter bore provided in a cylinder head of an internal combustion engine, comprising:

a cylindrical outer peripheral surface having a groove engageable with a projection in the lifter bore formed at least partially for preventing rotation of the valve lifter; and an accommodation chamber in which at least a stem end portion of a valve is accommodated, wherein a center axis of the cylindrical outer peripheral surface and a center axis of the accommodation chamber are offset, the groove being formed on the outer peripheral surface at a position corresponding to a thick wall portion at which a distance between the outer peripheral surface and the accommodation chamber generated by the offset becomes substantially maximum.

* * * * *